US007458571B2

(12) United States Patent
Ogawa

(10) Patent No.: US 7,458,571 B2
(45) Date of Patent: Dec. 2, 2008

(54) SHEET FEEDING APPARATUS, AND IMAGE FORMING APPARATUS

(75) Inventor: Daisuke Ogawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 396 days.

(21) Appl. No.: 11/315,183

(22) Filed: Dec. 23, 2005

(65) Prior Publication Data

US 2006/0157915 A1 Jul. 20, 2006

(30) Foreign Application Priority Data

Dec. 27, 2004 (JP) ..... 2004-377685

(51) Int. Cl.
*B65H 3/06* (2006.01)

(52) U.S. Cl. ..... 271/118

(58) Field of Classification Search ..... 271/118
See application file for complete search history.

(56) References Cited

U.S. PATENT DOCUMENTS

| | | | | |
|---|---|---|---|---|
| 3,981,497 | A * | 9/1976 | Feinstein et al. | 271/126 |
| 4,717,139 | A | 1/1988 | Sootome et al. | |
| 4,925,062 | A * | 5/1990 | Tsukamoto et al. | 271/115 |
| 5,346,199 | A * | 9/1994 | Martin et al. | 271/110 |
| 5,441,246 | A * | 8/1995 | Miyata et al. | 271/9.11 |
| 5,842,694 | A * | 12/1998 | Brooks et al. | 271/38 |
| 6,332,608 | B1 * | 12/2001 | Tamura | 271/111 |
| 6,425,578 | B1 * | 7/2002 | Wood et al. | 271/37 |
| 6,540,220 | B2 * | 4/2003 | Kuo et al. | 271/118 |
| 6,547,236 | B1 * | 4/2003 | Yip et al. | 271/115 |
| 6,823,791 | B1 * | 11/2004 | Richardson et al. | 101/477 |
| 2003/0057630 | A1 * | 3/2003 | Quesnel | 271/9.08 |
| 2005/0218584 | A1 * | 10/2005 | Dan | 271/127 |
| 2006/0113722 | A1 * | 6/2006 | Hattori | 271/121 |
| 2006/0180986 | A1 * | 8/2006 | Hattori | 271/110 |
| 2006/0180987 | A1 * | 8/2006 | Hattori | 271/117 |
| 2006/0267269 | A1 * | 11/2006 | Yano et al. | 271/127 |

FOREIGN PATENT DOCUMENTS

| | | |
|---|---|---|
| JP | A-54-077959 | 6/1979 |
| JP | A 02-026040 | 2/1990 |
| JP | A 02-123040 | 5/1990 |
| JP | A 02-062451 | 12/1990 |
| JP | 03-158326 | 7/1991 |
| JP | A 07-172624 | 7/1995 |
| JP | A 2518904 | 5/1996 |
| JP | A 09-110185 | 4/1997 |

(Continued)

*Primary Examiner*—Patrick H Mackey
*Assistant Examiner*—Howard Sanders
(74) *Attorney, Agent, or Firm*—Oliff & Berridge, PLC

(57) ABSTRACT

When a print request signal for a single sheet is input after a sheet feeding cassette has been reset, lapse of a reference time "t" is waited after switching of a sheet feeding roller has been performed. After a sheet-pressing plate has been lifted from a loading position to a feeding position, rotational driving of the sheet feeding roller is performed, thereby effecting sheet-feeding operation. When a print request signal for a second sheet or subsequent sheets is input, the sheet-pressing plate has already been in the feeding position, and hence the rotational driving of the sheet feeding roller is performed immediately after switching of the paper-feeding roller 12 has been performed.

14 Claims, 26 Drawing Sheets

FOREIGN PATENT DOCUMENTS

| | | |
|---|---|---|
| JP | A 10-236676 | 9/1998 |
| JP | A 2001-031257 | 2/2001 |
| JP | A 2001-080774 | 3/2001 |
| JP | A 2001-196223 | 7/2001 |
| JP | A 2002-3013 | 1/2002 |
| JP | A 2002-284365 | 10/2002 |
| JP | A 2003-194099 | 7/2003 |
| JP | A 2003-237986 | 8/2003 |

* cited by examiner

SHEET FEEDING APPARATUS, AND IMAGE FORMING APPARATUS

CROSS REFERENCE TO RELATED APPLICATION

This application claims priority from Japanese Patent Application No. 2004-377685 filed on Dec. 27, 2004, the entire subject matter of which is incorporated herein by reference.

TECHNICAL FIELD

The present invention relates to a sheet feeding apparatus and an image forming apparatus, and more particularly, to control of operation for feeding a sheet.

BACKGROUND

There is disclosed in JP-A-2001-080774 a sheet feeding apparatus having a pickup roller (a delivery roller) that comes into contact with a sheet loaded in a loading section which is provided so as to be vertically movable; and a separation mechanism including a sheet feeding roller (a separation roller) and a separation pad (separation member), both of which are provided downstream of the pickup roller with respect to a transport direction. The sheet feeding apparatus operates in such a way that, as a result of the pickup roller rotating while remaining in contact with the sheet on the loading section, the sheet is delivered to the separation mechanism, and such that the sheet is separated one sheet at a time by means of nipping action performed by the sheet feeding roller and the separation roller and the thus-separated sheet is further transported downstream in the transport direction.

Provided that the pickup roller remains in contact with the sheet at all times, there arises a problem of paper dust or transporting noise being induced by friction between the pickup roller and the sheet or a problem of an increase in transporting load. To solve the problem, the sheet feeding apparatus disclosed in JP-A-2001-080774 activates a solenoid switch at a point in time when the sheet has arrived at a nip position between the sheet feeding roller and the separation roller, thereby separating the pickup roller from the sheet on the loading section.

In an attempt to reduce the size and cost of the apparatus, desire exists for a structure which performs operation for separating the pickup roller by means of gear control while mechanically detecting the position of the pickup roller with minimal use of a custom-designed detection sensor and the like. According to this structure, the loading section is elevated in accordance with the position of the pickup roller. Namely, the loading section is actuated to elevate the position of the pickup roller, which is to come into contact with the sheet on the loading section. When the position of the pickup roller has arrived at a predetermined height, actuation of the loading section is deactivated. When the pickup roller has lowered by a predetermined level as a result of a decrease in the volume of sheet, the loading section is again actuated upwardly.

However, according to this structure, when a housing cassette having the loading section is again set for replenishing the loading section with the sheet, the pickup roller is situated at an initial position spaced away from the sheet, and the loading section is situated at the lowest point. As mentioned previously, the structure is configured to switch elevation of the loading section in accordance with the position of the pickup roller. Accordingly, elevation of the loading section is not commenced until after a gear mechanism has been driven to a certain extent, and hence there arises a problem of occurrence of a failure to feed a sheet (a pickup failure).

SUMMARY

One aspect of the present invention may provide a sheet feeding apparatus and an image forming apparatus, which are capable of performing feeding operation normally even when a housing cassette is reset.

A sheet feeding apparatus includes: a main body; a housing cassette that has a loading section on which a sheet is loaded and is provided to be movable in a vertical direction, the housing cassette being attached to the main body to be drawable therefrom; a delivery roller that is provided to be movable in the vertical direction and rotates while remaining in contact with an upper surface of the sheet loaded on the loading section to deliver the sheet downstream with respect to a conveying direction of the sheet; an elevation mechanism that elevates the loading section on condition that a moving position of the delivery roller is a predetermined height or less while the delivery roller stays in a feed position where the delivery roller contacts with the sheet loaded on the loading section; a position switching mechanism that switches between an initial position where the delivery roller is separated from the loading section and the feed position; a drive unit that causes the position switching mechanism to perform switching operation for switching the delivery roller from the initial position to the feed position in accordance with a sheet feeding start signal and subsequently rotationally drives the delivery roller; a determination unit that determines whether or not operation for attaching the housing cassette to the main body is performed; and a timing control unit that controls a timing, at which the rotational driving is started from the switching operation, to be later in a case where determined by the determination unit that the attachment operation is performed than in a case where determined by the determination unit that the attachment operation is not performed.

An image forming apparatus includes: a sheet feeding apparatus that accommodates and feeds a sheet; and an image forming section that forms an image on the sheet fed from the sheet feeding apparatus, wherein the sheet feeding apparatus includes: a main body; a housing cassette that has a loading section on which a sheet is loaded and is provided to be movable in a vertical direction, the housing cassette being attached to the main body to be drawable therefrom; a delivery roller that is provided to be movable in the vertical direction and rotates while remaining in contact with an upper surface of the sheet loaded on the loading section to deliver the sheet downstream with respect to a conveying direction of the sheet; an elevation mechanism that elevates the loading section on condition that a moving position of the delivery roller is a predetermined height or less while the delivery roller stays in a feed position where the delivery roller contacts with the sheet loaded on the loading section; a position switching mechanism that switches between an initial position where the delivery roller is separated from the loading section and the feed position; a drive unit that causes the position switching mechanism to perform switching operation for switching the delivery roller from the initial position to the feed position in accordance with a sheet feeding start signal and subsequently rotationally drives the delivery roller; a determination unit that determines whether or not operation for attaching the housing cassette to the main body is performed; and a timing control unit that controls a timing, at which the rotational driving is started from the switching operation, to be later in a case where determined by the determination unit that the attachment operation is performed than in a case where determined by the determination unit that the attachment operation is not performed.

DETAILED DESCRIPTION

One illustrative aspect of the present invention will now be described by reference to FIGS. 1 to 26.

Overall Configuration of an Illustrative aspect

Figure 1:
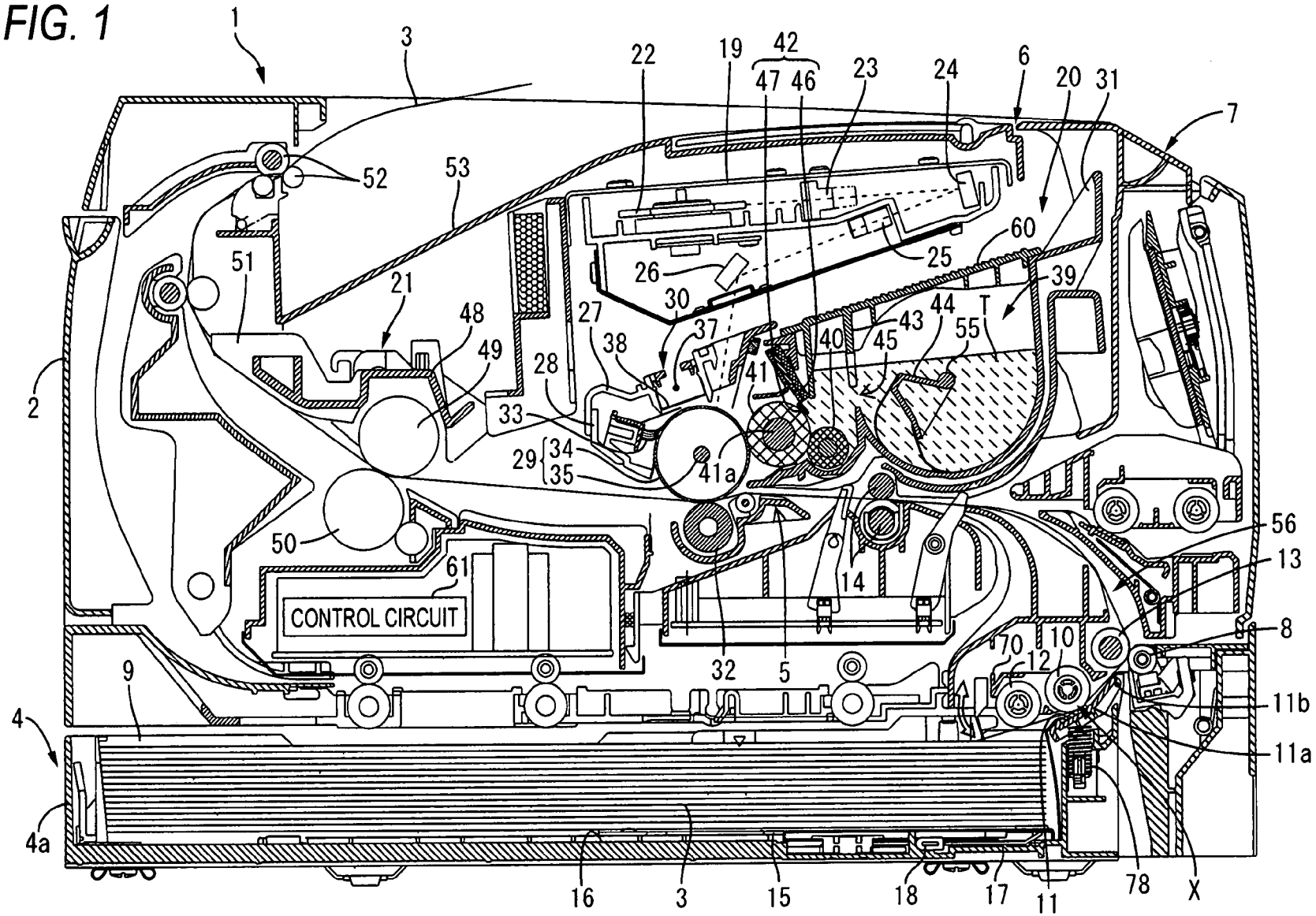
FIG. 1 is a side cross-sectional view of a principal section, showing a laser printer according to an illustrative aspect of the present invention.

FIG. 1 is a side cross-sectional view of a principal section, showing a laser printer. The laser printer 1 has a main body casing 2; a feeder section 4 that serves as a "sheet feeding apparatus" which is housed in the main body casing 2 and feeds a sheet 3 as a sheet; and an image forming section 5 for forming an image on the fed sheet 3.

The term "sheet" used herein may designate arbitrary recording medium; e.g. an OHP sheet, and the like, which are used as recording mediums.

The term "sheet feeding apparatus" may designate an apparatus which is removably attached to the main body of an image forming apparatus (a printer, a facsimile machine, a multifunction machine having a printer function and a scanner function, or a like machine) or an apparatus which cannot be removably attached. Moreover, the sheet feeding apparatus is not limited to an apparatus used for feeding a sheet to the main body of the image forming apparatus, but maybe an apparatus which is provided in another apparatus for counting the number of sheets; e.g., paper money or the like.

The term "housing cassette" may designate a cassette which can be removed or not removed from the main body of the image forming apparatus, so long as the apparatus can be drawn from the main body of the apparatus.

The term "drive source" may designate a drive source which is incorporated in the sheet feeding apparatus or a drive source which is disposed outside the sheet feeding apparatus; e.g., in an object to which the sheet is to be fed (e.g., the main body of the image forming apparatus).

Main Body Casing

An attachment-and-detachment port 6 used for removing and attaching a process cartridge 20 to be described later is formed in one sidewall of the main body casing 2, and the removable attachment port 6 is provided with a front cover 7 which opens and closes the attachment-and-detachment port 6. The front cover 7 is pivotally supported by a cover shaft (not shown) insert into a lower end portion of the front cover 7. When the front cover 7 is closed while taking the cover shaft as a center, the attachment-and-detachment port 6 is closed by the front cover 7 as shown in FIG. 1. When the front cover 7 is opened (inclined) while taking the cover shaft as a fulcrum, the attachment-and-detachment port 6 is released. The process cartridge 20 can be removably attached to the main body casing 20 by way of the attachment-and-detachment port 6.

In the following description, with the process cartridge 20 being attached to the main body casing 2, the part of the main body casing where the front cover 7 is provided is taken as a front side, whilst the other part of the same is taken as a rear side.

Feeder Section

The feeder section 4 has a sheet feeding cassette 9 that serves as a "housing cassette" and being attached, in a drawable manner, to a bottom section within the main body section 2; a separation roller 10 and a separation pad 11, which are provided at positions above a front end portion of the sheet feeding cassette 9; and a sheet feeding roller 12 that serves as a "delivery roller" provided in the rear of the separation roller 10 at a position upstream of the separation pad 11 with respect to the transport direction of the sheet 3. The feeder section 4 also has a paper dust removal roller 8 disposed at a position above and forward of the separation roller 10, the position downstream of the separation roller 10 with respect to the transport direction of the sheet 3, so as to oppose the separation roller 10; and an opposing roller 13 disposed opposite the paper dust removal roller 8.

A transport path 56 of the sheet 3 is folded rearward into the shape of the letter U from the neighborhood of the location where the paper dust removal roller 8 is disposed. A registration roller 14 consisting of a pair of rollers is provided at a position below the process cartridge 20 and further downstream of the folded area with respect to the transport direction.

A sheet-pressing plate 15 that serves as a "loading section" which enables loading of the sheets 3 in a stacked manner is provided in the sheet feeding cassette 9. A rear end portion of the sheet-pressing plate 15 is supported in a swingable manner between a loading position (shown in FIG. 1) where a front end portion of the sheet-pressing plate 15 is situated downward and stays in line with a bottom plate 16 of the sheet feeding cassette 9 and a feeding position (shown in FIGS. 14 to 17) where the front end portion is situated upward in an inclined manner.

A lever 17 used for lifting the front end portion of the sheet-pressing plate 15 is provided at the front end portion of the sheet feeding cassette 9. A rear end portion of this lever 17 is swingably supported by a lever shaft 18 at a position below the front end portion of the sheet-pressing plate 15. The lever 17 is swingable between a face-down position (shown in FIG. 1) where the front end portion of the lever 17 faces downward against the bottom plate 16 of the sheet feeding cassette 9 and an inclined position (shown in FIGS. 11 to 14) where the front end portion of the lever 17 lifts the sheet-pressing plate 15. When rotational driving force, which is clockwise in the drawing, is input to the lever shaft 18, the lever 17 rotates while taking the lever shaft 18 as a fulcrum, whereby the front end portion of the lever 17 lifts the front end portion of the sheet-pressing plate 15, thereby moving the sheet-pressing plate 15 to the feeding position.

When the sheet-pressing plate 15 has come to the feeding position, the sheets 3 on the sheet-pressing plate 15 are pressed against the sheet feeding roller 12. By means of rotation of the sheet feeding roller 12, feeding of a sheet toward a separation position X between the separation roller 10 and the separation pad 11 is initiated.

Meanwhile, when the sheet feeding cassette 9 is drawn from the feeder section 4, the front end portion of the sheet-pressing plate 15 moves downward under its own weight, whereupon the sheet-pressing plate 15 comes to the loading position, and the sheets 3 can be loaded on the sheet-pressing plate 15 in a stacked manner. The separation pad 11, the paper dust removal roller 8, the sheet-pressing plate 15, and the lever 17 are provided on the sheet feeding cassette 9. The paper-feeding roller 12, the separation roller 10, the opposing roller 13, and the registration roller 14 are provided on the main body casing 2. The feeder section 4, from which the sheet feeding cassette 9 has been removed, serves as an "apparatus main body 4*a*". FIG. 1 shows that the sheet feeding cassette 9 is inserted into the apparatus main body 4*a*, to thus have finished being arranged in a regular housing position.

When being nipped in the separation position X between the separation roller 10 and the separation pad 11 by means of rotation of the separation roller 10, the sheets 3 sent toward the separation position X by the sheet feeding roller 12 are separately fed one sheet at a time by means of rotation of the separation roller 10. The thus-fed sheet 3 is turned back along the U-shaped transport path 56. More specifically, the fed sheet 3 is first transported upward by passing between the separation roller 10 and the separation pad 11. Further, the sheet 3 is subjected to removal of paper dust while passing between the paper dust removal roller 8 and the opposing roller 13, and is then transported to the registration roller 14. The direction in which the sheet 3 is fed corresponds to a direction that is "downstream in the transport direction of a sheet".

After having registered the sheet 3, the registration roller 14 transports the sheet 3 to a transfer position between a photosensitive drum 29 and a transfer roller 32, which will be described later, where a toner image on the photosensitive drum 29 is transferred to the sheet 3.

Image forming section

The image forming section 5 includes a scanner section 19, the process-cartridge 20, and a fixing section 21.

Scanner Section

The scanner section 19 is disposed at a higher position within the main body casing 2, and includes an unillustrated laser light source, a polygon mirror 22 which is rotationally driven, an fθ lens 23, a reflection mirror 24, a lens 25, a reflection mirror 26, and the like. The laser beam that has been emitted from a laser light source in accordance with image data is deflected by the polygon mirror 22 as indicated by a chain line. After the laser beam has passed through the fθ lens 23, an optical path of the laser beam is turned back by the reflection mirror 24. After the laser beam has further passed through the lens 25, the optical path of the laser beam is further bent downward by the reflection mirror 26, to thus fall on the surface of the photosensitive drum 29, which will be described later, of the process cartridge 20.

Process Cartridge

The process cartridge 20 is removably attached to the main body casing 2 at a position below the scanner section 19. The process cartridge 20 has, as an enclosure, an upper frame 27, and a lower frame 28, which is formed separately from the upper frame 27 and is to be combined with the upper frame 27. The process cartridge 20 includes, in the enclosure, the photosensitive drum 29, a scorotron electrification device 30, a development cartridge 31, the transfer roller 32, and a cleaning brush 33.

The photosensitive drum 29 has a drum main body 34 which assumes a cylindrical shape and whose outermost surface is formed from a positively-electrified photosensitive layer made from polycarbonate, or the like; and a metal drum shaft 35 serving as a shaft which extends along the axis of the drum main body 34 in the longitudinal direction thereof. The drum shaft 35 is supported by the upper frame 27, and the drum main body 34 is supported so as to be rotatable about the drum shaft 35, whereby the photosensitive drum 29 is provided on the upper frame 27 so as to be rotatable about the center of the drum shaft 35.

The scorotron electrification device 30 is supported by the upper frame 27, and is disposed at an upper position obliquely rearward of the photosensitive drum 29 so as to oppose the photosensitive drum 29 with a predetermined distance therefrom so as not to come into contact with the photosensitive drum 29. This scorotron electrification device 30 has a discharge wire 37 disposed opposite the photosensitive drum 29 with a predetermined interval therebetween; and a grid 38 which is interposed between the discharge wire 37 and the photosensitive drum 29 and controls the level of electric discharge from the discharge wire 37 to the photosensitive drum 29. The scorotron electrification device 30 applies a high voltage to the discharge wire 37 simultaneously with application of a bias voltage to the grid 38, to thus cause the discharge wire 37 to effect corona discharge. Thus, the surface of the photosensitive drum 29 can be positively electrified in a uniform manner.

The development cartridge 31 has a box-shaped housing case 60 whose rear portion is opened, and is removably attached to the lower frame 28. A toner storage chamber 39, a toner-feeding roller 40, a development roller 41, and a layer thickness regulatory blade 42 are provided within the development cartridge 31.

The toner storage chamber 39 is formed as a front internal space of the housing case 60 partitioned by a partition plate 43. The toner storage chamber 39 is filled with positively-electrified nonmagnetic one-component toner T serving as a developing agent.

An agitator 44 supported by a rotary shaft 55 disposed in the center of the toner storage chamber 39 is provided in the toner storage chamber 39. This agitator 44 is rotationally driven by an input of power from an unillustrated motor. When the agitator 44 is rotationally driven, the toner T in the toner storage chamber 39 is stirred and discharged toward the toner-feeding roller 40 by way of an opening section 45 which is formed in a lower portion of the partition plate 43 to thus form a longitudinal passage.

The toner-feeding roller 40 is disposed rearward of the opening section 45, and is supported by the development -cartridge 31 in a rotatable manner. The toner-feeding roller 40 is formed by covering a metal roller shaft with a roller made of a conductive foamed material. This toner-feeding roller 40 is rotationally driven by an input of power from an unillustrated motor.

The development roller 41 is located rearward of the toner-feeding roller 40 and rotatably supported by the development cartridge 31 while remaining in mutually-compressed contact with the toner-feeding roller 40. The development roller 41 opposes and contacts the photosensitive drum 29 while the development cartridge 31 remains attached to the lower frame 28. The development roller 41 is formed by covering a metal roller shaft 41*a* with a roller formed from a conductive rubber material. Both ends of the roller shaft 41*a* protrude outward from side faces of the development cartridge 31 at the front end portion thereof, in a lateral direction orthogonal to the longitudinal direction. During development operation, a development bias is applied to the development roller 41. By means of an input of power from the unillustrated motor, the development roller 41 is rotationally driven in the same direction as is the toner-feeding roller 40.

The layer thickness regulatory blade 42 has a pressing section 47 which is provided at the extremity of a blade main body 46 formed from a metal leaf spring material and is formed from insulating silicon rubber; and which assumes a semicircular cross-sectional profile. The layer thickness regulatory blade 42 is supported by the development cartridge 31 at a position above the development roller 41, and the pressing section 47 is compressed onto the development roller 41 by means of elastic force of the blade main body 46.

The toner T discharged out of the opening section 45 is fed to the development roller 41 by means of rotation of the toner-feeding roller 40. At this time, the toner is positively electrified through friction between the toner-feeding roller 40 and the development roller 41. The toner T fed over the development roller 41 enters between the pressing section 47 of the layer thickness regulatory blade 42 and the development roller 41 in association with rotation of the development roller 41, and is carried over the development roller 41 as a thin layer of given thickness.

The transfer roller 32 is rotationally supported by the lower frame 28. In a state where the upper frame 27 and the lower frame 28 are combined together, the transfer roller 32 is arranged so as to oppose and contact the photosensitive drum 29 in the vertical direction, to thus forma nip between the photosensitive drum 29 and the transfer roller 32. The transfer roller 32 is formed by covering a metal roller shaft 32*a* with a roller made of a conductive rubber material. During transfer operation, a transfer bias is applied to the transfer roller 32. The transfer roller 32 is rotationally driven in a direction opposite the photosensitive drum 29 by means of an input of power from the unillustrated motor.

The cleaning brush 33 is attached to the lower frame 28. In the state where the upper frame 27 and the lower frame 28 are combined together, the cleaning brush 33 is arranged so as to oppose and contact the photosensitive drum 29 at a position rearward thereof.

In association with rotation of the photosensitive drum 29, the surface of the photosensitive drum 29 is first uniformly, positively electrified by the scorotron electrification device 30. Subsequently, the surface is exposed to a high-speed scan of the laser beam output from the scanner section 19, thereby forming an electrostatic latent image corresponding to the image to be formed on the sheet 3.

Next, when the positively-electrified toner carried on the development roller 41 opposes and contacts the photosensitive drum 29 by means of rotation of the development roller 41, the toner is fed to the electrostatic latent image formed on the surface of the photosensitive drum 29; namely, exposed areas on the uniformly, positively-electrified surface of the photosensitive drum 29, where electric potentials of the areas are reduced upon exposure to the laser beam. As a result, the electrostatic latent image of the photosensitive drum 29 is visualized, and a toner image formed through negative development is carried on the surface of the photosensitive drum 29.

As shown in FIG. 1, the toner image carried on the surface of the photosensitive drum 29 is transferred to the sheet 3 by means of the transfer bias applied to the transfer roller 32 within a period during which the sheet 3 transported by the registration roller 14 passes through the transfer position between the photosensitive drum 29 and the transfer roller 32. The sheet 3—on which the toner image is transferred—is transported to the fixing section 21.

Fixing Section

The fixing section 21 is provided rearward of the process cartridge 20 and includes a fixing frame 48, and a heating roller 49 and a pressure roller 50, both of which are provided within the fixing frame 48.

The toner transferred on the sheet 3 at the transfer position is thermally fixed by the fixing section 21 during the course of the sheet 3 passing between the heating roller 49 and the pressure roller 50. The sheet 3 having the toner fused thereon is transported to a sheet output path 51 which extends vertically toward the upper surface of the main body casing 2. The sheet 3 transported to the sheet output path 51 is output to a sheet output tray 53 formed in the upper surface of the main body casing 2, by means of a sheet output roller 52 disposed at a position above the paper output path 51.

Structure of the Sheet Feeding Roller and that of the Separation Roller

Figure 2:
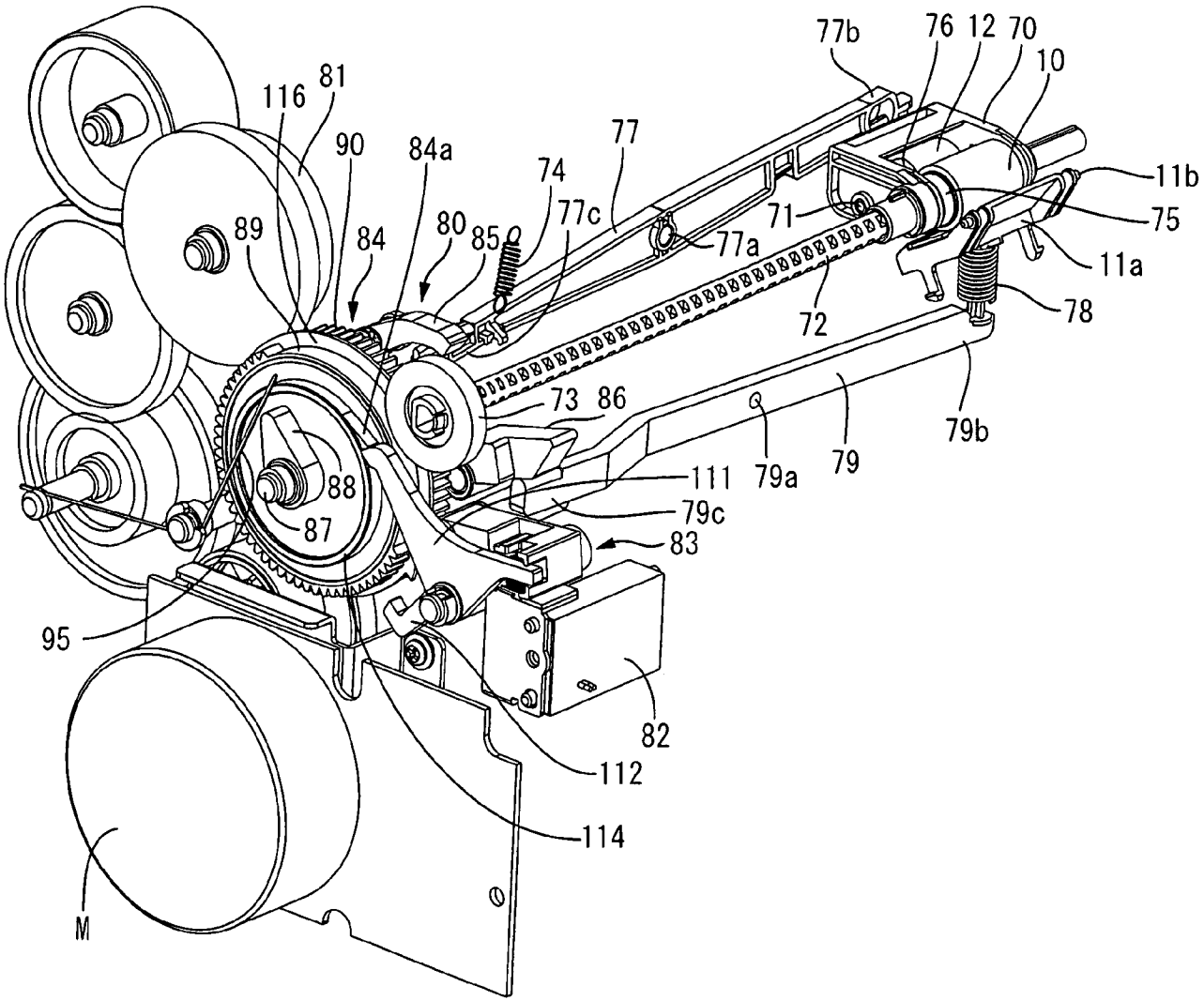
FIG. 2 is a perspective view of a gear mechanism when viewed from the front.

FIG. 2 is a perspective view of a gear mechanism when viewed from the front. In the drawing, a lower right direction of the drawing sheet corresponds to a front end of the laser printer 1, and an upper left direction of the same corresponds to a rear end of the same.

As shown in FIG. 2, the sheet feeding roller 12 and the separation roller 10 are received by a bearing member 70 in a rotatable manner, with rotary shaft bodies 71, 72 being arranged side by side in a direction orthogonal to the conveying direction. The rotary shaft bodies 71, 72 are formed from resin, and indentations to be used for preventing occurrence of sink marks are formed in outer peripheral surfaces of the respective rotary shaft bodies 71, 72. One of the ends of the rotary shaft body 72 of the separation roller 10 penetrates through one (a left end in the drawing sheet of FIG. 2) of sidewall sections of the bearing member 70, and a separation roller gear 73 is provided integrally at the extremity of the end. The rotary shaft body 72 rotates as a result of the separation roller gear 73 receiving driving force from a gear mechanism 80 to be described later. The separation roller 10 pivots integrally in association with rotation of the rotary shaft body 72.

The area of the bearing member 70 located on the part of the sheet feeding roller 12 sways around the rotary shaft body 72 of the separation roller 10 (indicated by the outlined arrow in FIG. 1). A sheet-pressing plate 15 is elevated and driven by means of pivotal movement of the lever shaft 18. As a result, the surface of the sheet 3 on top of a pile of sheets loaded on the sheet-pressing plate 15 comes into contact with the sheet feeding roller 12 from below, whereupon the sheet feeding roller 12 is swung upwardly.

Gears which rotate integrally with the respective rotary shaft bodies 71, 72 (of these gears, only a gear 75, which rotates integrally with the rotary shaft body 72, is illustrated) are provided coaxially with the sheet feeding roller 12 and the separation roller 10. The rollers 10, 12 are synchronously rotated by way of a coupling gear 76 which mesh with the gears 75; namely, the sheet feeding roller 12 is rotated so as to follow pivotal movement of the roller 10 as a result of pivotal movement of the separation roller 10.

Switching Mechanism of the Sheet Feeding Roller

As shown in FIG. 2, an arm member 77, which is parallel with the rotary shaft body 72 and whose substantial center position 77*a* is supported in a rotatable manner, is provided rearward of the rotary shaft body 72 (in an upper left direction of the drawing sheet). One end 77*b* of the arm member 77 is engaged with a swaying-end of the shaft bearing member 70 where the sheet feeding roller 12. A remaining end 77*c* of the arm member is engaged with a gear mechanism 80. The arm member 77 is bias upwardly by a spring member 74. The arm member 77 is impelled upwardly by the end 77*c* and the spring member 74.

Figure 3:
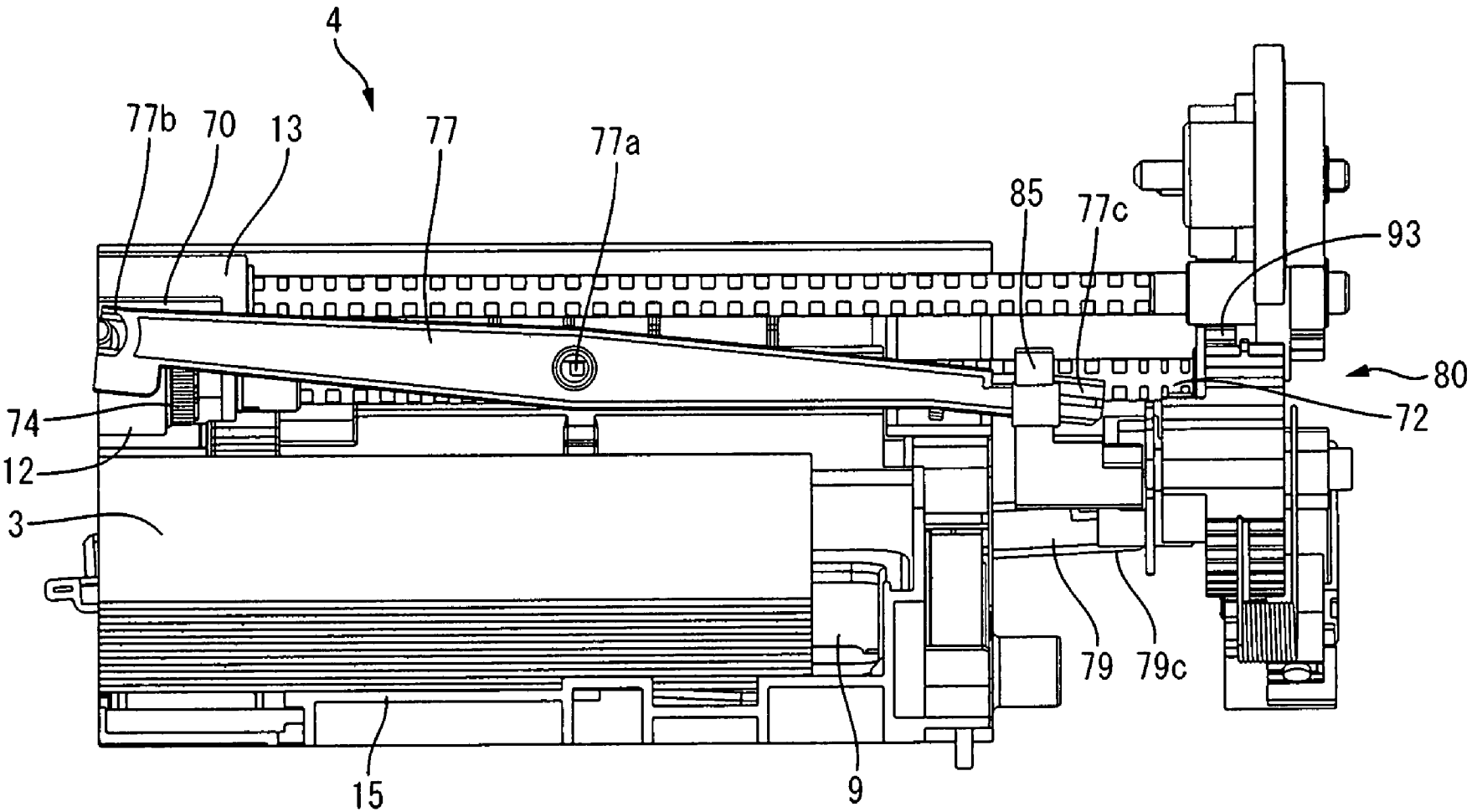
FIG. 3 is a front view of the feeding section when viewed from the back in a state where the sheet feeding roller 12 is in an initial position.
Figure 4:
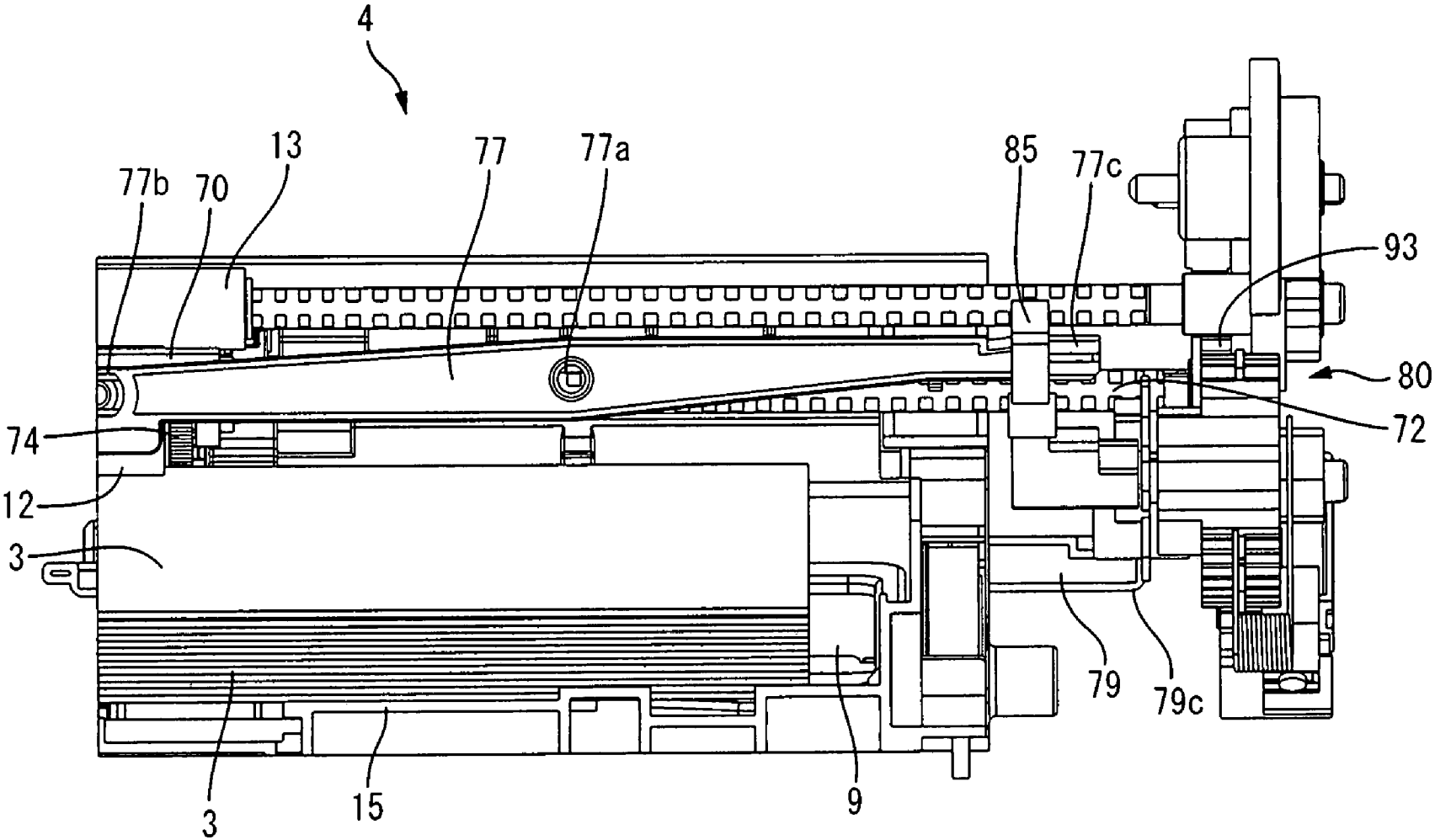
FIG. 4 is a front view of the feeder section when viewed from the back in a state where the sheet feeding roller 12 is in a sheet-feeding position.

FIG. 3 is a front view of the feeding section 4 when viewed from the back in a state where the sheet feeding roller 12 is in a separated position; i.e., an "initial position", and FIG. 4 is a front view of the feeder section 4 when viewed from the back in a state where the sheet feeding roller 12 is in a contact position; i.e., a "feed position" which will be hereinafter described as a "sheet-feeding position". In the drawings, a direction toward the viewer corresponds to the rear end of the laser printer 1, and a direction away from the viewer corresponds to the front end of the laser printer 1.

As shown in FIG. 3, by means of such a structure, the other end 77*c* of the arm member 77 is lowered by the gear mechanism 80, so that the sheet feeding roller 12 moves to the initial position separated from the pile of sheets loaded on the sheet-pressing plate 15. In contrast, as shown in FIG. 4, when the lowering force exerted by the gear mechanism 80 is canceled, the sheet feeding roller 12 vertically moves downward under its own weight, to thus come to the sheet-feeding position where the sheet feeding roller 12 contacts the pile of sheets loaded on the sheet-pressing plate 15.

Mechanism for Changing Pressure existing between the Separation Pad and the Separation Roller As show in FIG. 1, the separation pad 11 is laid on a rectangular layout plate 11*a*. As a result of the front end of the layout plate 11*a* being supported by a support shaft 11*b* in a rotatable manner, the rear end of the layout plate 11*a* becomes swingable. A spring member 78 (e.g., a coil spring) is pressed against a lower surface of the layout plate 11*a* from down toward up. The separation pad 11 is pressed against the separation roller 10 by means of the impelling force of the spring member 78.

As shown in FIG. 2, the an arm member 79, which is parallel to the rotary shaft body 72 and whose center position 79*a* is supported in a rotatable manner, is provided at a position below the rotary shaft body 72. One end 79*b* of the arm member 79 is brought into contact with the lower end of the spring member 78, and a remaining end 79*c* is engaged with the gear mechanism 80 which will be described later.

Figure 5:
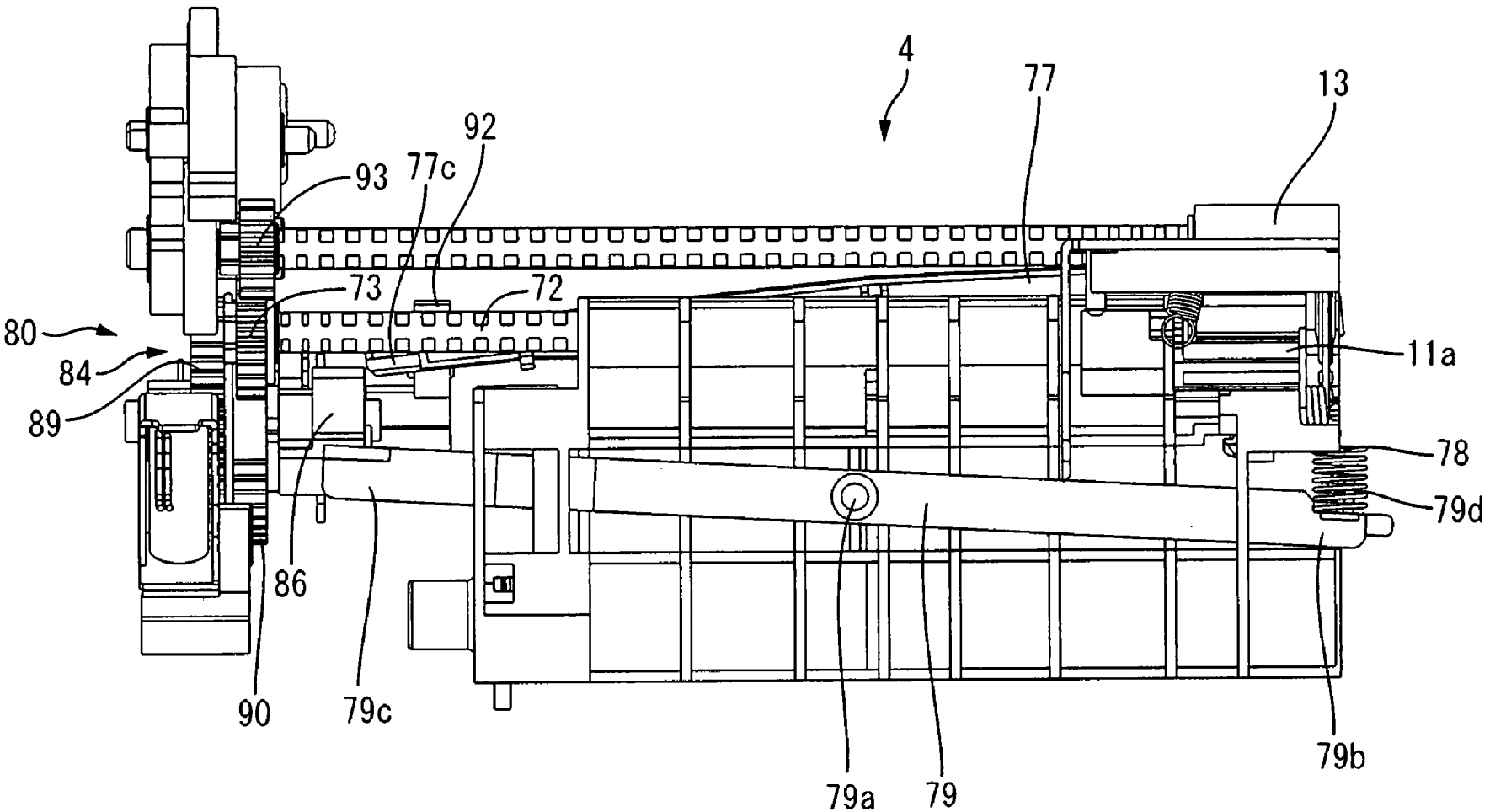
FIG. 5 is a front view of the feeder section when viewed from the front in a low-pressure state.
Figure 6:
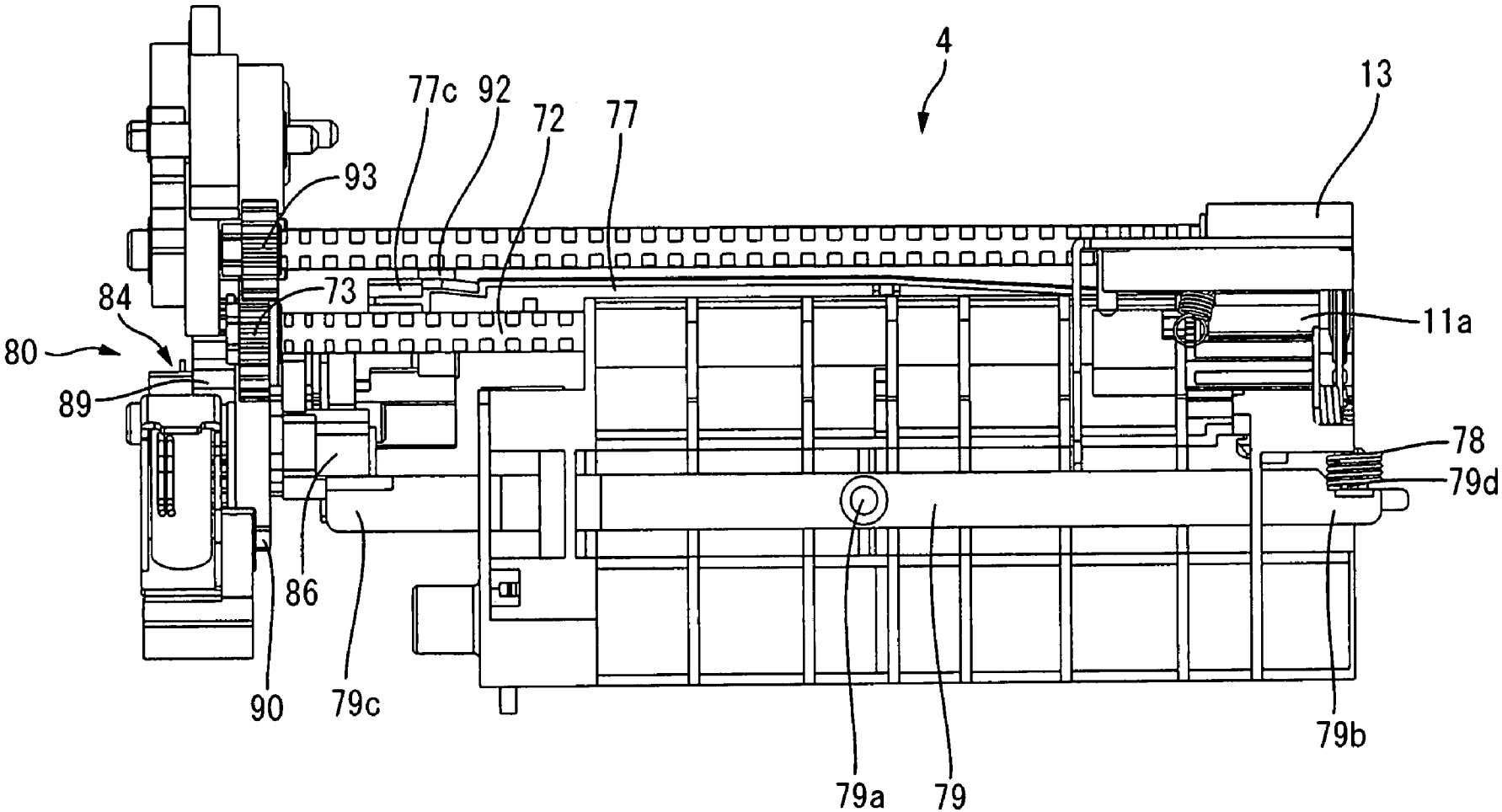
FIG. 6 is a front view of the feeder section when viewed from the front in a high-pressure state.

FIG. 5 is a front view of the feeder section when viewed from the front in a low-pressure state, and FIG. 6 is a front view of the feeder section when viewed from the front in a high-pressure state. In these drawings, a direction toward the viewer corresponds to the front end of the laser printer 1, and a direction away from the viewer corresponds to the rear end of the laser printer 1.

As shown in FIG. 5, by means of such a configuration, when the other end 79*c* of the arm member 79 is situated at an elevated position, the one end 79*b* is situated at a lowered position. The spring member 78 is compressively deformed (this state will be hereinafter called a "low-pressure state") by the amount corresponding to the distance over which the one end 79*b* is separated from the back of the layout plate 11*a*. In contrast, as shown in FIG. 6, when the other end 79*c* of the arm member 79. is moved downwardly, the one end 79*b* moves upwardly, to thus push the lower end portion of the spring member 78. The spring member 78 is compressively deformed to a further extent. Thus, the pressing force of the separation pad 11 exerted on the separation roller 10 can be made greater than that achieved in the low-pressure state (this state will be hereinafter called a "high-pressure state").

As shown in FIGS. 5 and 6, a protrusion section 79*d* is formed in an upright position on one end 79*b* of the arm member 79. This protrusion section 79*d* is inserted into the lower end of the spring member 78. As a result, occurrence of positional displacement between the end 79*b* and the spring member 78 is regulated.

Gear Mechanism

The gear mechanism 80 will now be described. The gear mechanism 80 has a plurality of gears which rotate upon receipt of driving force from a drive motor M (corresponding to a "drive source" of the present invention, and see FIG. 2) provided on the part of the main body casing 2. This gear mechanism 80 chiefly controls the following operations.

(a) Control of operation for rotating the separation roller 10 and the sheet feeding roller 12 by rotation of the rotary shaft body 72 (hereinafter called "roller drive operation" which corresponds to "rotational drive of a delivery roller" of the present invention).

(b) Control of operation for elevating or lowering the sheet feeding roller 12 by vertical movement of the end 77*c* of the arm member 77 (hereinafter called a "sheet feeding roller switching operation").

(c) Control of operation for changing pressure developing between the separation roller 10 and the separation pad 11 by vertical movement of the end 79*c* of the arm member 79 (hereinafter called "operation for reducing pressure").

(d) Control of operation (hereinafter called "sheet-pressing plate elevating operation") of a loading section elevation mechanism which pivots the lever 17 until the sheet feeding roller 12 comes to a predetermined height where a sheet can be fed with the sheet feeding roller 12 being located at a sheet-feeding position, to thus elevate the sheet-pressing plate 15; and which, when the sheet feeding roller 12 has come to the predetermined height, stops pivotal movement of the lever 17. Here, the term "predetermined height" is a height at which the sheet feeding roller 12 comes into contact with the upper surface of the top sheet 3 on the sheet-pressing plate 15 at an appropriate pressure and can feed a sheet properly.

Specifically, as shown in FIG. 2, the gear mechanism 80 includes the separation roller gear 73, an input gear 81, a solenoid switch 82, a solenoid lever 83, a sector gear 84, a lift lever 85, a separation lever 86, and the like.

Solenoid Switch and Solenoid Lever

Figure 7:
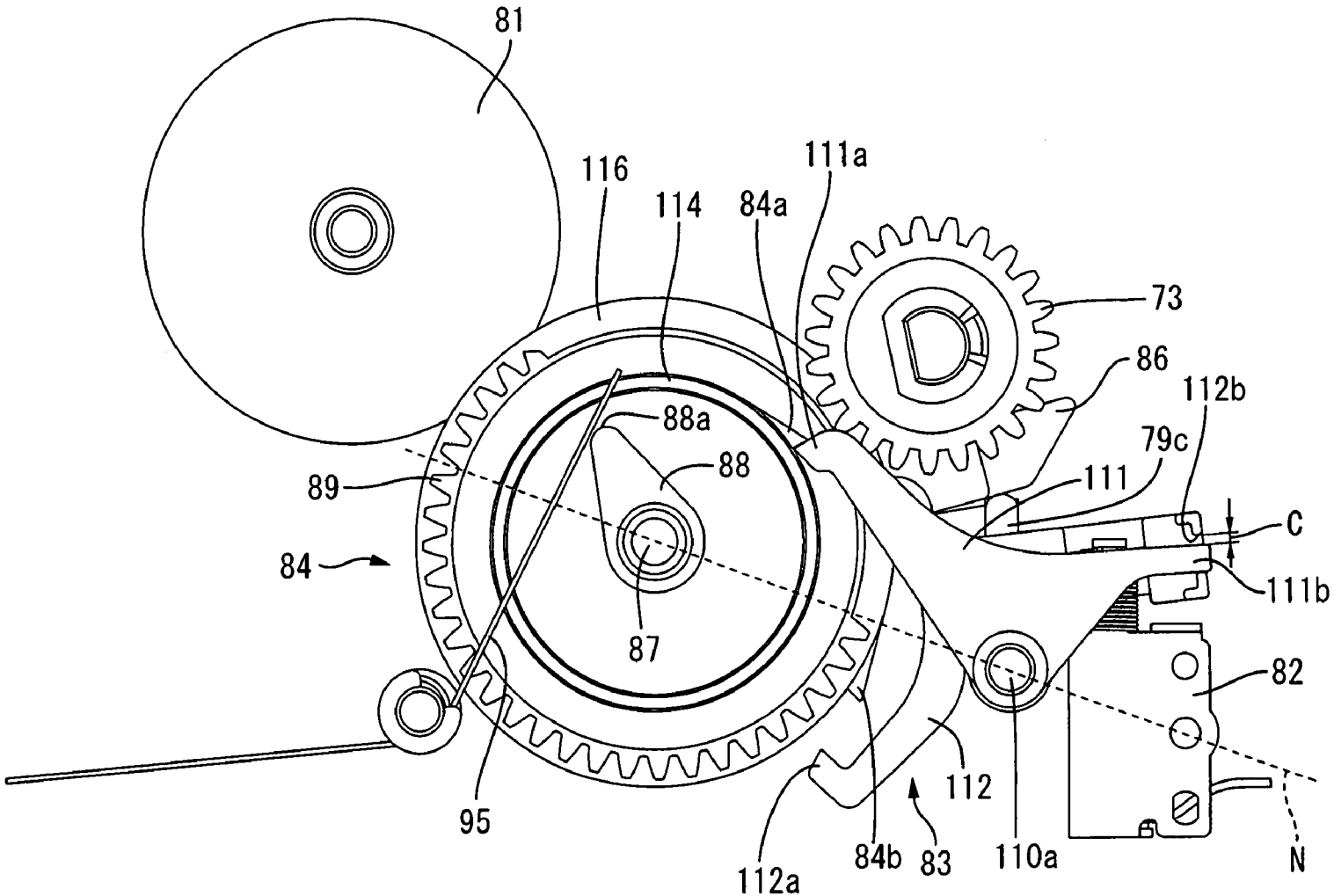
FIG. 7 is a simplified view of the configuration of the gear mechanism when viewed from the right.
Figure 8:
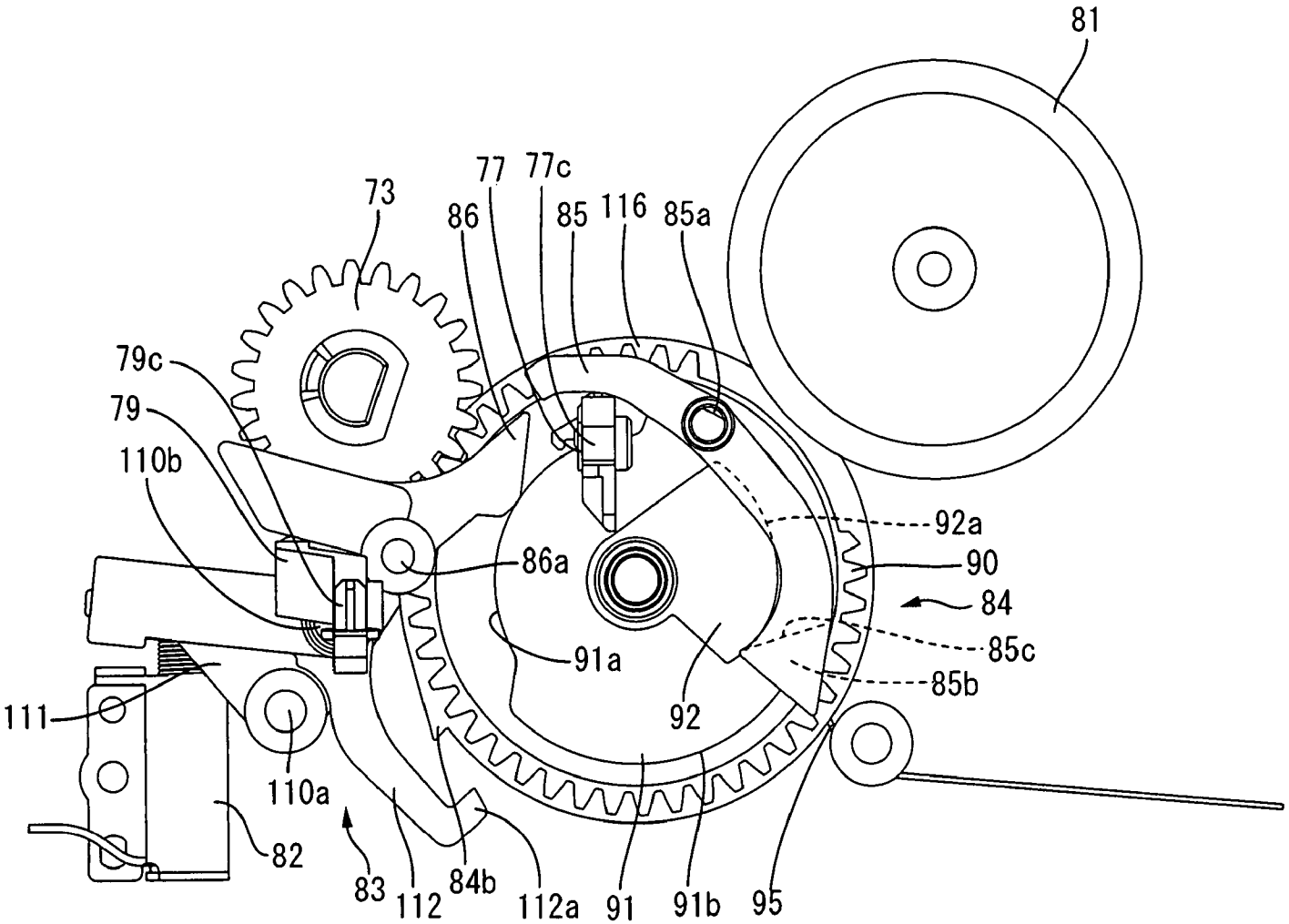
FIG. 8 is a simplified view of the configuration of the gear mechanism when viewed from the left.
Figure 9:
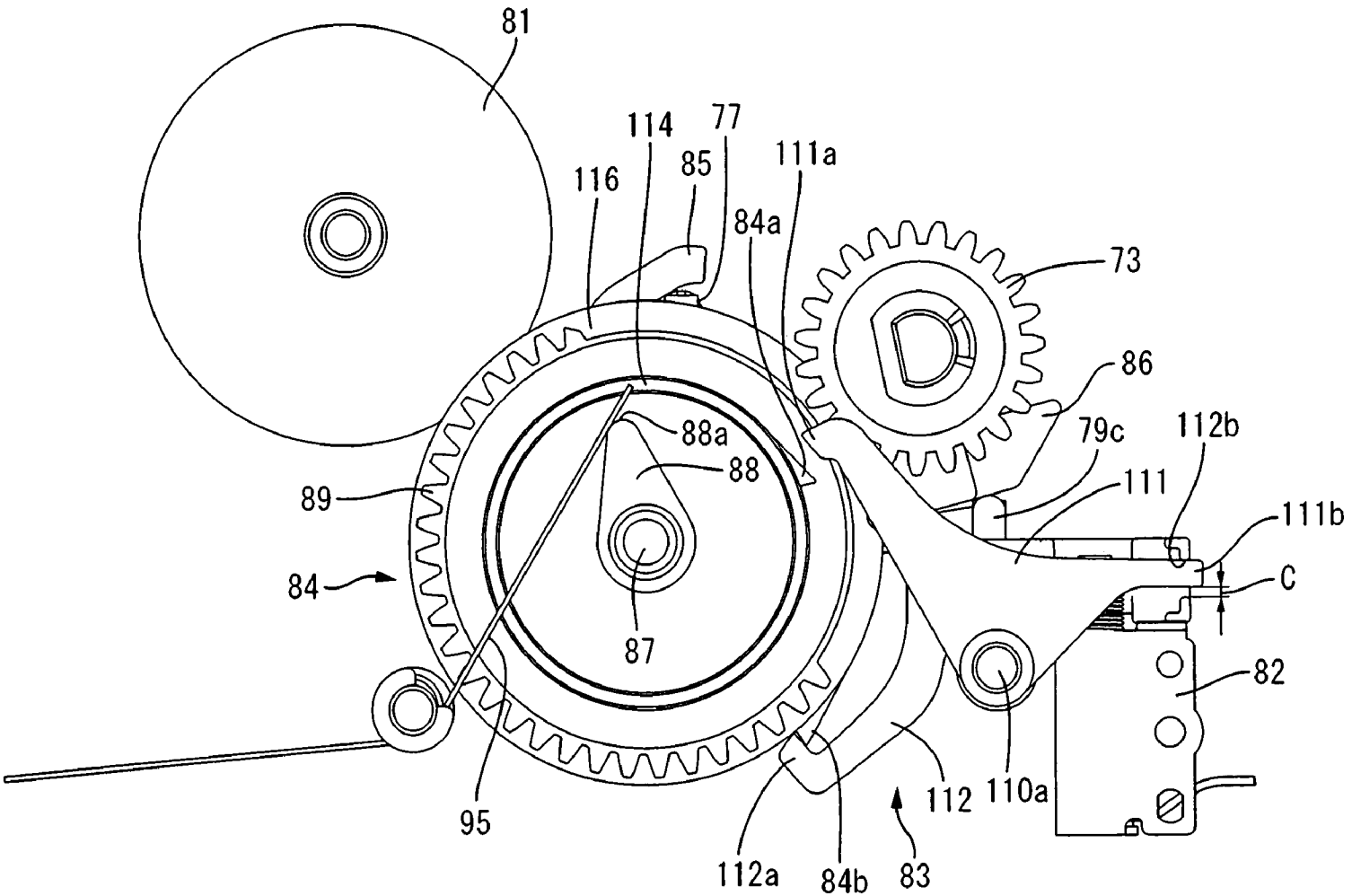
FIG. 9 is a simplified view of the configuration of the gear mechanism when viewed from the right.
Figure 10:
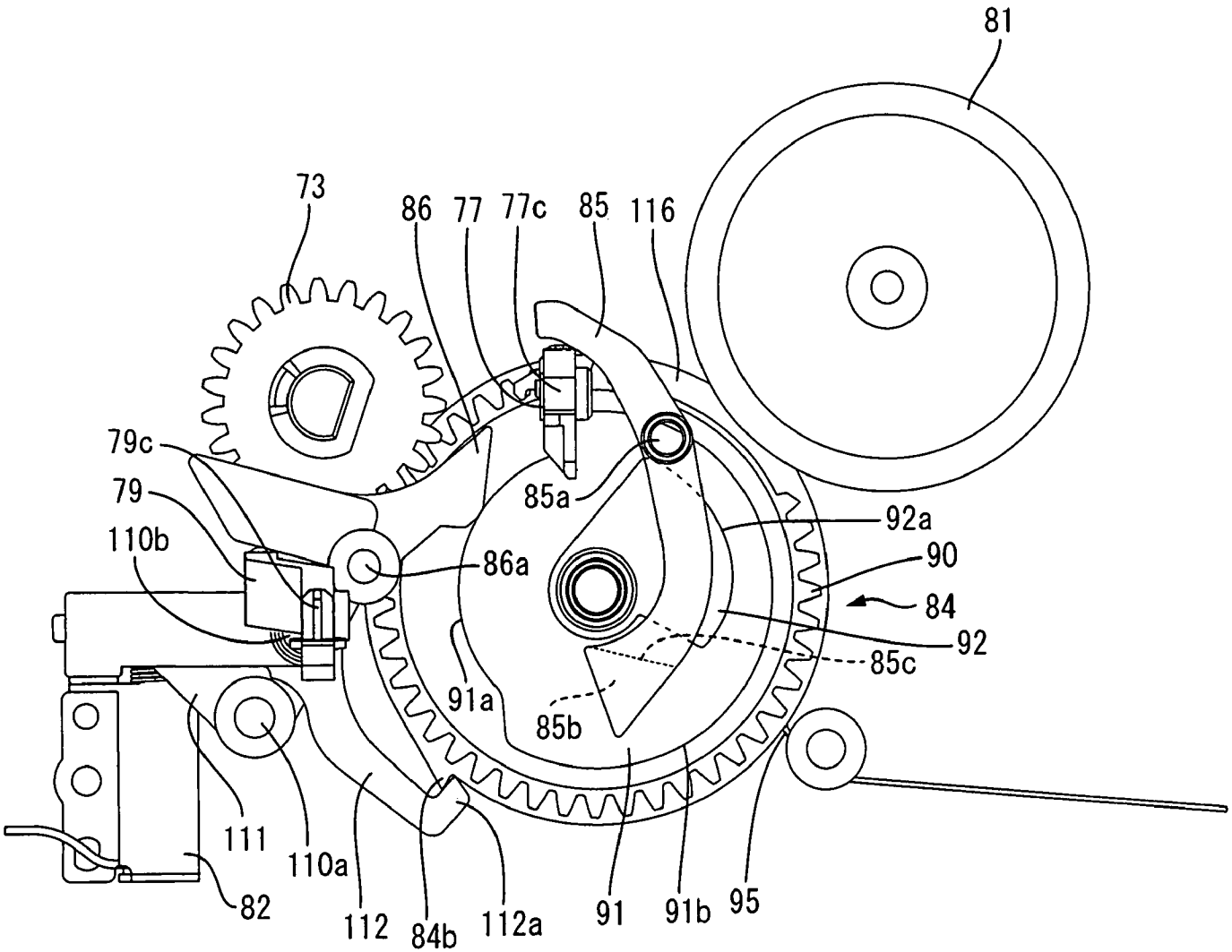
FIG. 10 is a simplified view of the configuration of the gear mechanism when viewed from the left.
Figure 11:
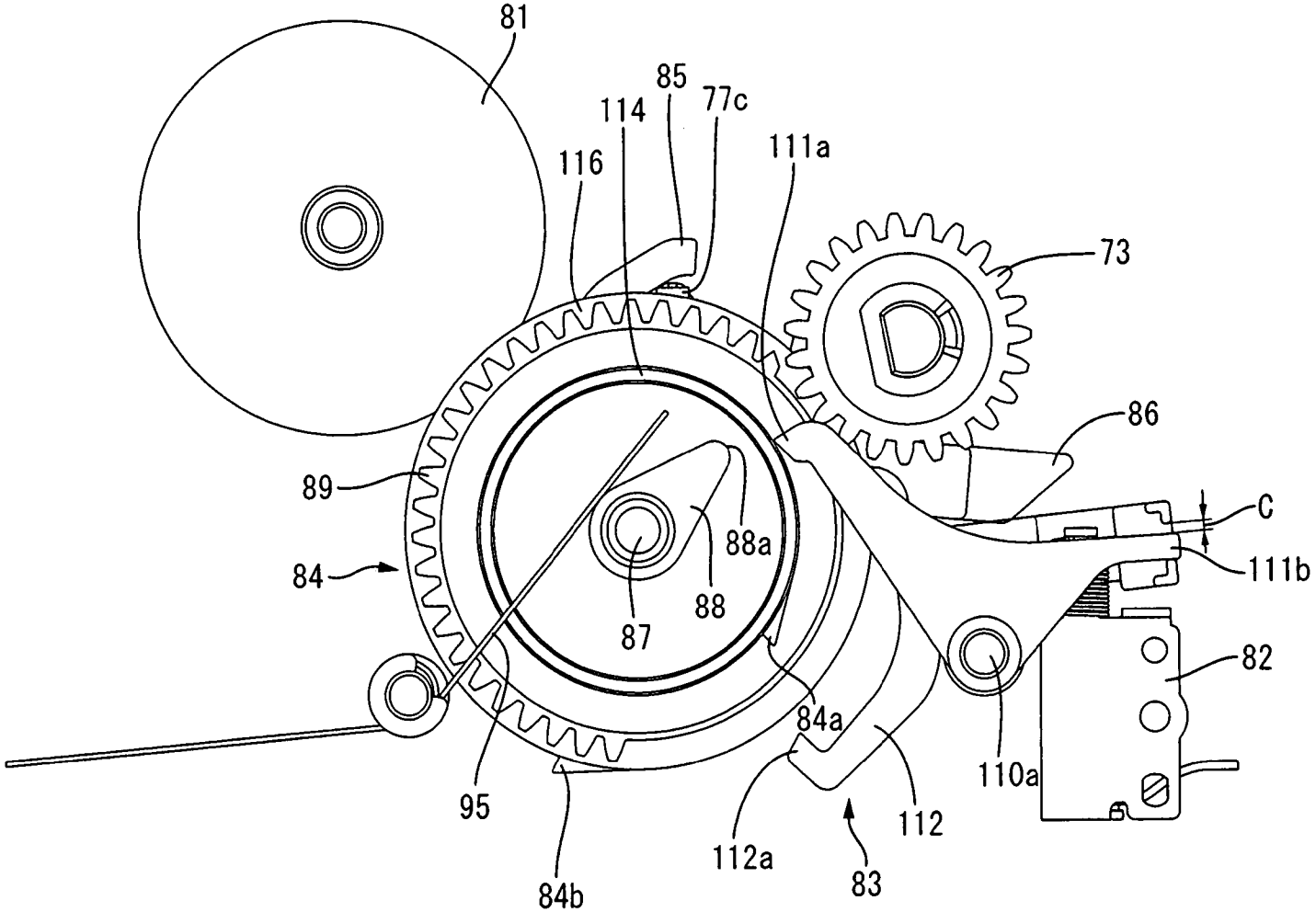
FIG. 11 is a simplified view of the configuration of the gear mechanism when viewed from the right.
Figure 12:
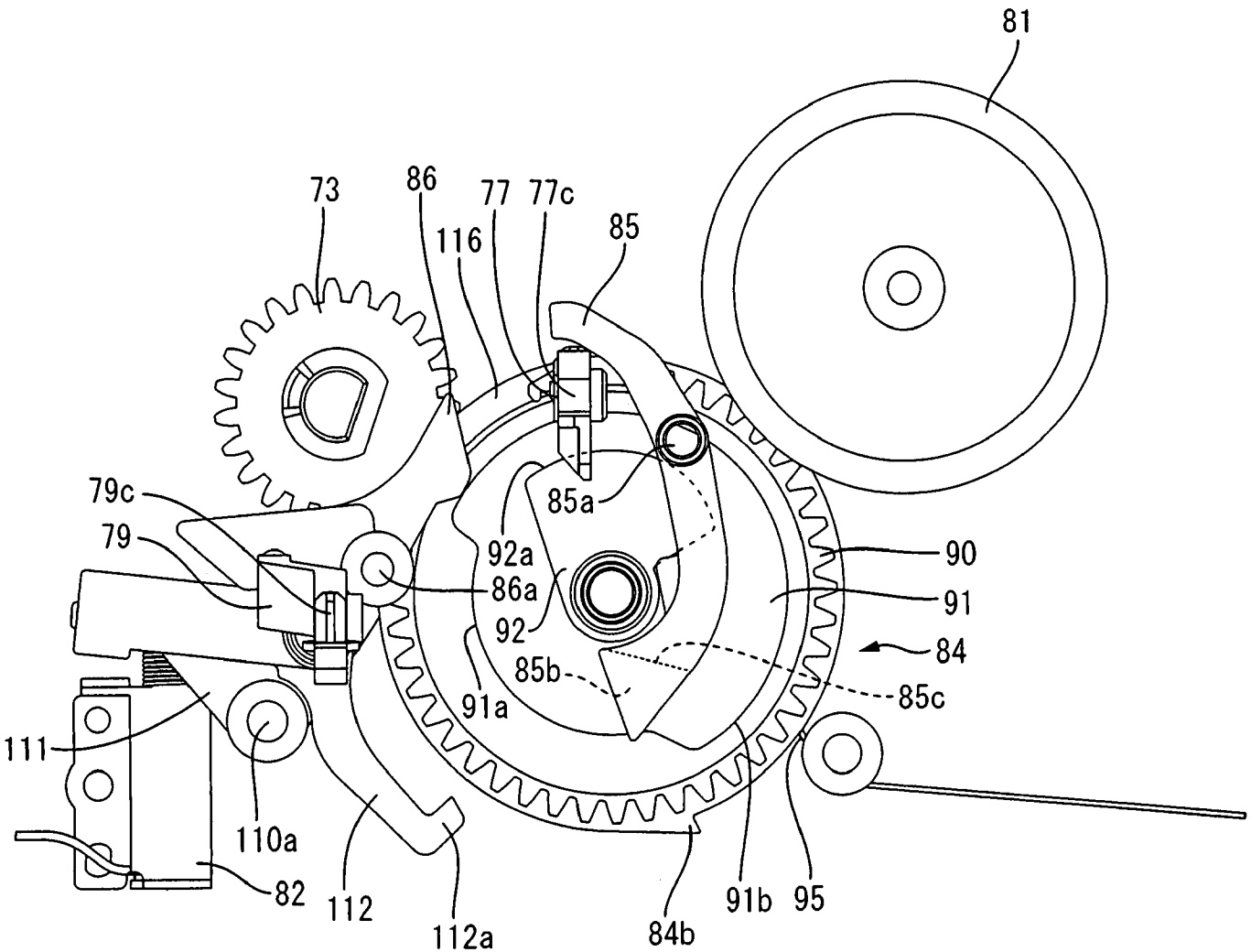
FIG. 12 is a simplified view of the configuration of the gear mechanism when viewed from the left.

FIGS. 7, 9, and 11 are simplified views of the gear mechanism when viewed in the same direction as in FIG. 1 (from the right side of the laser printer 1). In these drawings, the rightward direction of the drawing sheet corresponds to the front end of the laser printer 1, and the leftward direction of the same corresponds to the rear end of the laser printer 1. FIGS. 8, 10, and 12 are simplified views of the gear mechanism when viewed in a direction opposite to that in FIG. 1 (from the left side of the laser printer 1). In these drawings, the leftward direction of the drawing sheet corresponds to the front end of the laser printer 1, and the rightward direction of the same corresponds to the rear end of the laser printer 1.

Reference numeral 61 in FIG. 1 designates a schematically-shown control circuit. Upon receipt of a print request signal that serves as a "sheet supply start signal" which is based on a print request (to perform the image-forming) operation performed by the user or receipt of a print command signal by way of an external communications terminal connected to the laser printer, the control circuit controls to activate or deactivate the solenoid switch 82.

Upon receipt of a control signal from the control circuit 61, the solenoid switch 82 functions activation/deactivation switching mechanism. Here, the solenoid switch 82 is a keep solenoid switch which has a permanent magnet and maintains an active state even when power-on is interrupted in an active state unless an electric current reverse to that flowing during active operation is applied to the solenoid switch.

As shown in FIGS. 2, 7, and 8, the solenoid lever 83 includes a first solenoid arm 111 and a second solenoid arm 112 that serves as "first and second latch arms" supported in a swingable manner by axes 110*a*, 110*b* parallel to the rotary shaft 87 of the sector gear 84.

The first solenoid arm 111 and a second solenoid arm 112 may be integrally formed or may be formed separately.

Of the solenoid arms, the first solenoid arm 111 is integrally provided with a latch claw 111*a* which is provided at a tip end of the arm projecting in a back and up slanting direction and which can engage with a first latch protrusion 84*a* projecting from the sector gear 84/3;4. A latch engagement protrusion section 111*b* projecting forward of the laser printer 1 is formed integrally on the base end of the arm. The first solenoid arm 111 is swingable between a latch state (see FIGS. 7 and 11) where the solenoid arm can latch the first latch protrusion 84*a* and a retracted state (see FIG. 9) where the solenoid arm has receded from the position where latching is possible. The first solenoid arm 111 latches the first latch protrusion 84*a* at a position above the plane including the rotary shaft 87 and the axes 110*a*, 110*b* (designated by a broken line N in FIG. 7 and serves as a "plane including a rotary shaft and axes".

The second solenoid arm 112 is disposed at a position which is offset leftward with respect to the first solenoid arm 111 (a direction away from the viewer in the drawing sheet of FIG. 7). The second solenoid arm 112 is integrally provided with an engagement claw 112*a* which is provided at a tip end of the arm projecting in a back and down slanting direction and can engage with a second latch protrusion 84*b* projecting from the sector gear 84. A latch indentation 112*b*, into which the engagement protrusion 111*b* of the first solenoid arm 111 enters with allowance C in the swaying direction of the solenoid lever 83, is formed integrally with the base end of the arm. A base end of the second solenoid arm 112 is vertically actuated by activation or deactivation of the solenoid switch 82. Specifically, the second solenoid arm 112 enters the latch state (see FIG. 9) where the solenoid arm can latch the second latch protrusion 84*b* when the solenoid switch 82 is activated, but enters the retracted state (see FIGS. 7 and 11) where the second solenoid arm has receded from that position where latching is possible when the solenoid switch 82 is deactivated. The second solenoid arm 112 latches a second latch protrusion 84*b* at the position below with reference to the plane N.

As shown in FIG. 7, by means of such a structure, the second solenoid arm 112 stays in the retracted state when the solenoid switch 82 is deactivated. In contrast, as a result of the engagement protrusion 111*b* being pushed upwardly by a lower interior wall of the latch indentation 112*b*, whereupon the first solenoid arm 111 enters the latch state. As shown in FIG. 9, when the solenoid switch 82 is activated, the second solenoid arm 112 enters the latch state. In contrast, the engagement protrusion 111*b* is pushed downward by an upper interior wall of the latch indentation 112*b* at a delay timing corresponding to the amount of allowance C between the engagement protrusion 111*b* and the latch indentation 112*b*, whereupon the first solenoid arm 111 enters the retracted state. Specifically, latching action of the first solenoid arm 111 is terminated when the second solenoid arm 112 enters the latch state, so that the second solenoid arm 112 can perform latching operation without fail.

Sector Gear

The sector gear 84 includes a first cam 88, a first partially-toothed gear 89, a second partially-toothed gear 90, a second cam 91, and a third cam 92, all of which integrally rotate with respect to a single rotary shaft 87.

First Partially-Toothed Gear

As shown in FIG. 7, about one-third of the entire circumference of the first partially-toothed gear 89 is consecutively toothless. As a result of meshing with the separation roller gear 73, the first partially-toothed gear 89 allowances the role for pivotally driving the separation roller 10. In the states shown in FIGS. 7 and 9, the first partially-toothed gear 89 has not yet meshed with the separation roller gear 73, and hence the separation roller 10 remains to be able to idle. Specifically, the separation roller remains unable to perform the above-described roller drive operation.

First Cam and First Latch Protrusion

A first disk body 114, which is smaller than the first partially-toothed gear 89, is provided on the right side of the first partially-toothed gear 89 (in a lower left direction in FIG. 2 and a direction toward the viewer of FIG. 7), and a first cam 88 is further provided on the right side of the first disk body 114. The first latch protrusion 84*a* is provided integrally and projectingly at a position on an outer peripheral surface of the first disk body 114, which corresponds to the essentially center of the toothless portion of the first partially-toothed gear 89.

The first cam 88 has a shape having a large-diameter section 88*a* which projects in one radial direction to have a large diameter. A sector spring 95, which contacts the large-diameter section 88*a* in a compressed state and impels the sector gear 84 in a clockwise direction of the drawing of FIG. 7, the direction corresponding to the "rotational direction", is disposed rearward of the first cam 88. This sector spring 95 allowances the role of impelling the sector gear 84 in the rotating direction thereof: from a position forward of the location, where the first solenoid arm 111 engages with the first latch protrusion 84 as shown in FIG. 7 (hereinafter called a "first latch state"), to a position where the second solenoid arm 112 engages with the second latch protrusion 84*b* (hereinafter called a "second latch state") as shown in FIG. 9; and further to a position where the sector spring 95 is released from the second latch state and the second partially-toothed gear 90 meshes with the input gear 81.

Second Partially-Toothed Gear

As shown in FIGS. 2 and 8, a second disk body 116, which is essentially equal in diameter with the first partially-toothed gear 89, is disposed on the left side of the first partially-toothed gear 89 (in an upper left direction of the drawing sheet of FIG. 2 and a direction toward the viewer of the drawing sheet of FIG. 8) The second partially-toothed gear 90 is further disposed on the left side of the second disk body 116. The second latch protrusion 84*b* is integrally provided, in a projecting manner, forward of the first latch protrusion 84*a* on the outer peripheral surface of the second disk body 116 with respect to the rotating direction of the sector gear 84.

An essentially one-sixth of the entire circumference of the second partially-toothed gear 90 has no teeth. When having received an input of drive force from the drive motor M, the second partially-toothed gear 90 meshes with the input gear 81, to thus be rotationally driven. During a period in which the sector gear 84 transitions from the first latch state (FIGS. 7 and 8) to the second latch state (FIGS. 9 and 10), the second partially-toothed gear 90 is adjusted to oppose the input gear 91. Specifically, the drive force originating from the input gear 81 is not transmitted to the sector gear 84 at this time.

Second Cam

The second cam 91 is disposed on the left side of the second partially-toothed gear 90. An essentially one-quarter of the entire circumference of the second partially-toothed gear 90 is consecutively formed into a small-diameter section 91*a*. The separation lever 86 is provided in the vicinity of the second cam 91 so that an essentially center of the separation lever is supported in a rotatable manner. The front end of the separation lever 86 contacts from the above the end 79*c* of the arm member 79 used for changing the impelling force provided by the spring member 78. In contrast, the rear end of the separation lever 86 remains in contact with the outer peripheral surface of the second cam 91. By means of such a structure, the rear end of the separation lever 86 goes beyond the large-diameter section 91*b* from the small-diameter section 91*a* of the second cam 91, whereby the separation lever 86 is tilted such that the rear end thereof descends. Thus, the spring member 78 is compressively deformed, so that the pressure developing between the separation roller 10 and the separation pad 11 becomes greater. Specifically, operation for reducing the above-described pressure can be performed.

Third Cam

The third cam 92 is disposed on the left of the second cam 91. One-fourth of the entirety of the third cam 92 assumes a circular shape. The lift lever 85, which assumes of an essentially-bow-shaped geometry and whose center 85*a* is supported in a rotatable manner, is provided in the vicinity of the third cam 92. A contact section 85*b*, which projects rightward of the base end and has the shape of a triangular pole, is provided integrally with the lift lever 85. While the contact section 85*b* remains in contact with a circular-arc portion 92*a* of the third cam 92, the tip end of the contact section 85*b* pushes an end section 77*c* of the arm member 77, which is for elevating and lowering the sheet feeding roller 12, from up to down. Specifically, at this time, the sheet feeding roller 12 is situated in the initial position. In contrast, when the third cam 92 pivots to thus release the circular-arc portion 92*a* from the contact section 85*b* of the lift lever 85, the sheet feeding roller 12 latched by the lift lever 85 is released to move to the sheet-feeding position by means of the impelling force of the spring member 74. Specifically, the above-described sheet feeding roller switching operation can be performed. The input gear 81 is coupled to an unillustrated gear for rotationally driving the above-described opposing roller 13.

Loading Section Elevation Mechanism

Figure 13:
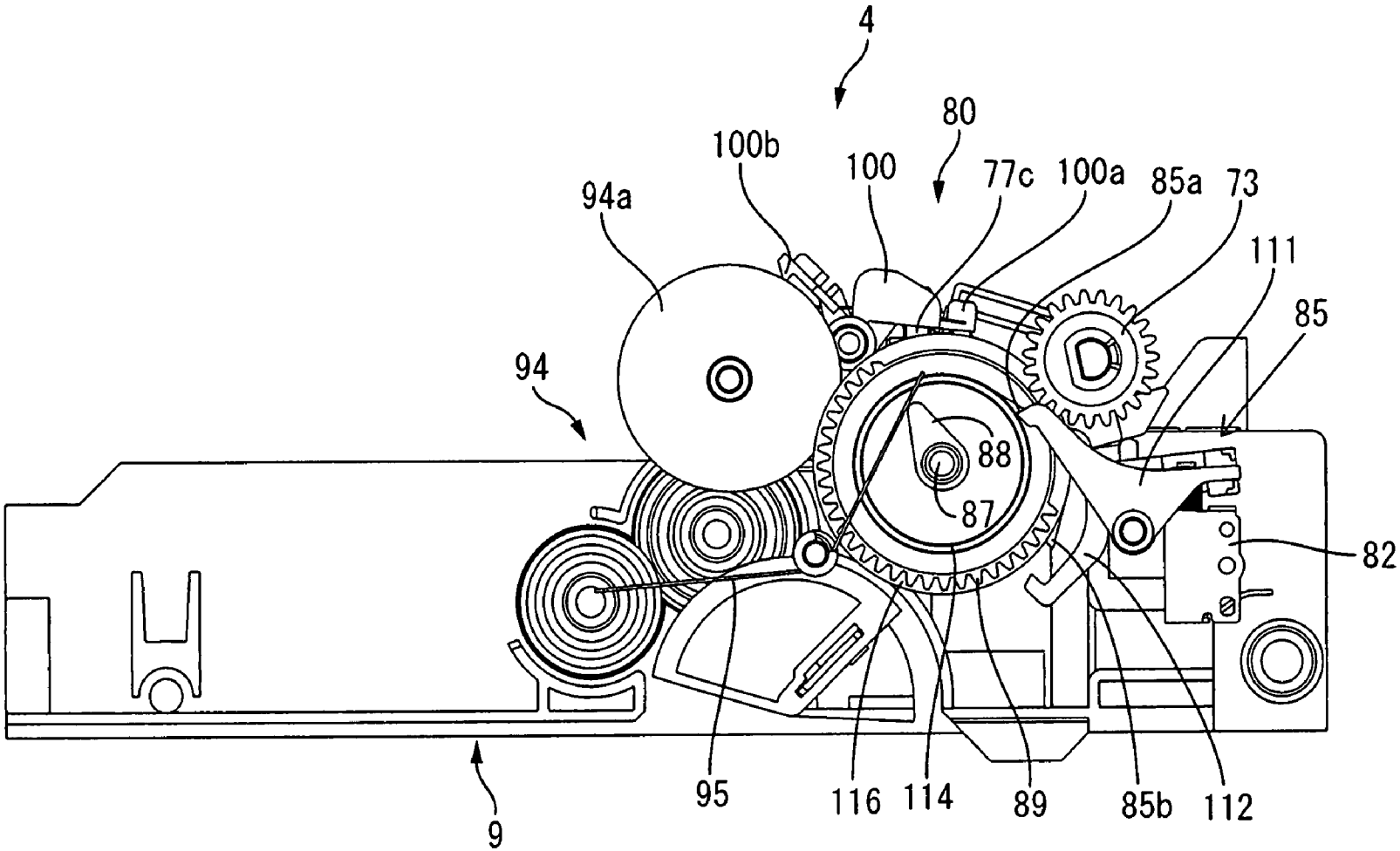
FIG. 13 is aright-side elevation view of the gear mechanism and a sheet feeding cassette.

FIG. 13 is a right-side elevation view of the gear mechanism 80 and the sheet feeding cassette 9. In the drawings, the rightward direction in the drawing sheet corresponds to the front end of the laser printer 1, and the leftward direction in the drawing corresponds to the rear end of the laser printer 1.

As shown in FIG. 13, the changeable tilt member 100 used for connecting/disconnecting driving for lifting the sheet-pressing plate is disposed rearward of the end 77*c* of the arm member 77. The center of this changeable tilt member 100 is axially supported by a rotary shaft parallel to the rotary shaft 87 of the respective gears 84, or the like, in a tiltable fashion. A front end portion 100*a* is situated at a position above the end 77*c* of the arm member 77, and a latch claw is provided integrally on the tip end of a rear end section 100*b*.

The end 77*c* of the arm member 77 is pushed downwardly by the lift lever 85. In a state where the sheet feeding roller 12 is situated in the initial position, the front end section 100*a* of the changeable tilt member 100 is lowered by an unillustrated urging member, and the rear end section 100*b* of the same is lifted. The pressing force exerted by the lift lever 85 is terminated, whereupon the end 77*c* of the arm member 77 moves upwardly. When the sheet feeding roller 12 has come to the sheet-feeding position, the front end 100*a* of the changeable tilt member 100 is elevated in association with moving action of the sheet feeding roller 12, thereby lowering the rear end section 100*b*. At this time, the latch claw of the rear end section 100*b* becomes able to mesh with the drive switching gear 94*a* of a group of control gears 94 which pivot the lever 17. As a result, the driving force originating from the input gear 81 is transmitted to the group of control gears 94, so that operation for lifting the sheet-pressing plate 15 becomes possible.

Basic Operation of the Laser Printer

FIGS. 14 to 17 are left cross-sectional views of the feeder section. In the drawings, the leftward direction in the drawing corresponds to the front end of the laser printer 1, and the rightward direction of the drawing corresponds to the rear end of the laser printer 1.

Home Position

Here, the term "home position" designates the first latch state shown in FIGS. 7 and 8. For instance, the home position designates, for example, a waiting state where the gear mechanism 80 returns to the first latch state after having normally completed sheet-feeding operation (delivery operation) and awaits a control signal (a signal used for activating the solenoid switch 82, which will be hereinafter called an "ON signal") for the next sheet 3 from the control circuit 61.

Figure 14:
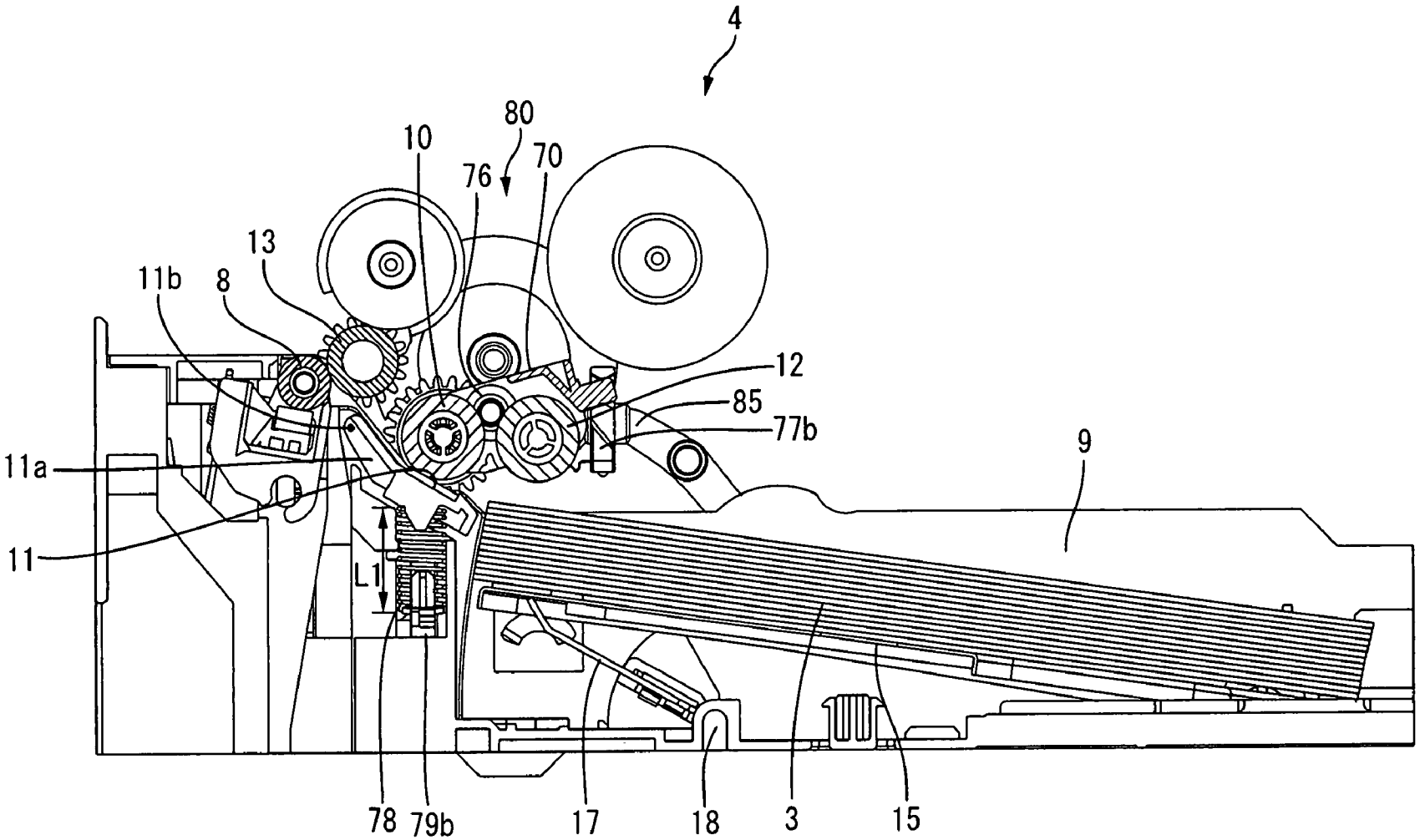
FIG. 14 is a left side cross-sectional view of a feeding section at a home position.

When the power of the laser printer 1 is turned on, the drive motor M is driven, and the resulting drive force is transmitted to the input gear 81. In association with transmission of the driving force, the opposing roller 13 is rotationally driven. At this time, the gear mechanism 80 is in the state shown in FIGS. 7 and 8. Specifically, the sector gear 84 is latched in the "first rotational position" in the present invention by the first solenoid arm 111, wherein the drive force is not transmitted from the input gear 81. Upon contacting the circular-arc portion 92*a* of the third cam 92, the lift lever 85 is latched in the state where the end section 77*c* of the arm 77 remains pushed downwardly. As shown in FIG. 14, the sheet feeding roller 12 is in an initial position spaced from a group of sheets loaded on the sheet-pressing plate 15 (see also FIG. 3).

At this time, the changeable tilt member 100 is restricted in the latch claw of the rear end section 100*b* engaging with the drive change gear 94*a* of the group of drive gears 94, whereby driving for lifting the sheet-pressing plate remains disconnected.

As shown in FIG. 7, the separation lever 86 remains in contact with the small-diameter section 91*a* of the second cam 91, thereby allowing upward movement of the end section 79*c* of the arm member 79. Specifically, the end section 79*c* of the arm member 79 is tilted downwardly, and the spring member 78 enters the low-pressure state (see also FIG. 5) where the spring member 78 is compressively deformed to a length corresponding to the distance over which the end section 79*b* and the layout plate 11*a* are spaced apart from each other (the length L1 shown in FIG. 11).

During Switching of the Sheet Feeding Roller

When a print request is issued and the ON signal for the first sheet 3 is given to the solenoid switch 82, the solenoid switch 82 is activated. Then, the second solenoid arm 112 enters the latch state, and the first solenoid arm 111 is released from the latched state with a little delay. The sector gear 84 rotates to a position, which corresponds to a "second rotational position", forward of the location where the first partially-toothed gear 86 and the input gear 81 mesh with each other, under the impelling force of the sector spring 95, thereby entering the second latch state shown in FIGS. 9 and 10.

Figure 15:
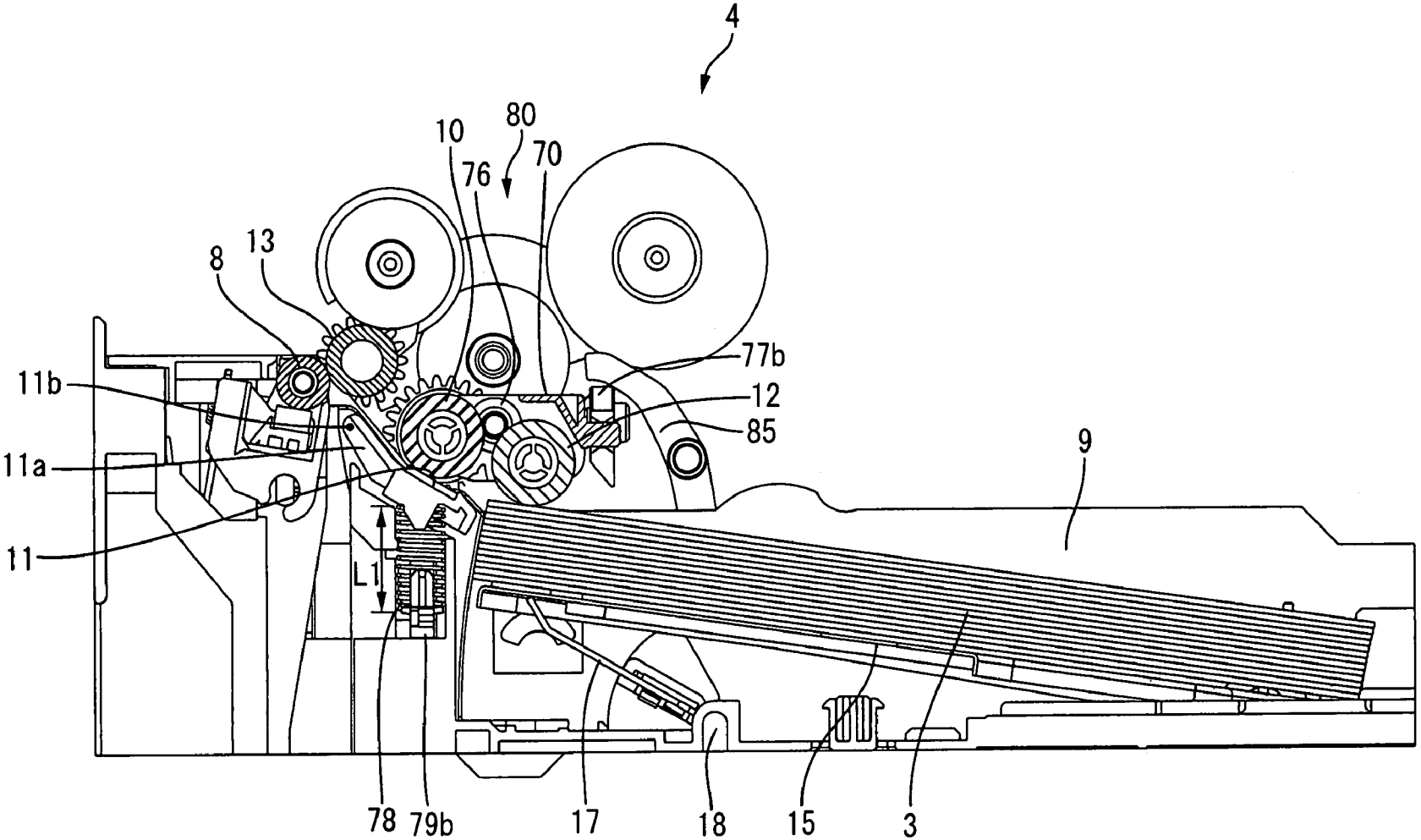
FIG. 15 is a left side cross-sectional view of the feeder section in a state where the sheet feeding roller has been moved downwardly.

The lift lever 85 is released from the latched state by means of rotation of the third cam 92, thereby allowing movement of the lift lever 85 to a position above the end 77*c* of the arm member 77. As shown in FIG. 15, the lift lever 85 descends to the sheet-feeding position where the sheet feeding roller 12 comes to the pile of sheets loaded on the sheet-pressing plate 15 (see also FIG. 4).

At this time, the changeable tilt member 100 performs sheet-pressing plate lifting operation, wherein the latch claw of the rear end section 100*b* can mesh with the drive switching gear 94*a* of the group of control gears 94. Specifically, when the sheet feeding roller 12 situated in the sheet-feeding position is located at a height lower than the predetermined height where the sheets 3 can be fed, the latch claw of the rear end section 100*b* engages with the drive switching gear 94*a* of the group of control gears 94, whereby the driving force is transmitted from the input gear 81 to the group of control gears 94, to thus elevate the sheet-pressing plate 15. When the sheet-pressing plate 15 has reached the predetermined height, the latch claw of the rear end section 100*b* is disengaged from the drive switching gear 94*a*, thereby terminating transmission of the driving force from the input gear 81 to the group of control gears 94. As a result, the sheet-pressing plate 15 comes to a stop at that height. Accordingly, the range of rotation of the sector gear 84 corresponding to a transition from the first latch state to the second latch state corresponds to the "switching rotation range".

Start of Sheet-Feeding Operation

Subsequently, when having received an OFF signal from the control circuit 61, the solenoid switch 82 is deactivated. As shown in FIGS. 11 and 12, the sector gear 84 latched by the second solenoid arm 112 is released to rotate to the position where the first partially-toothed gear 86 and the input gear 81 mesh with each other under the impelling force of a sector spring 95, whereby rotational driving of the sector gear 84 (i.e., transmission of driving force from the input gear 81 to the sector gear 84) is initiated.

Figure 16:
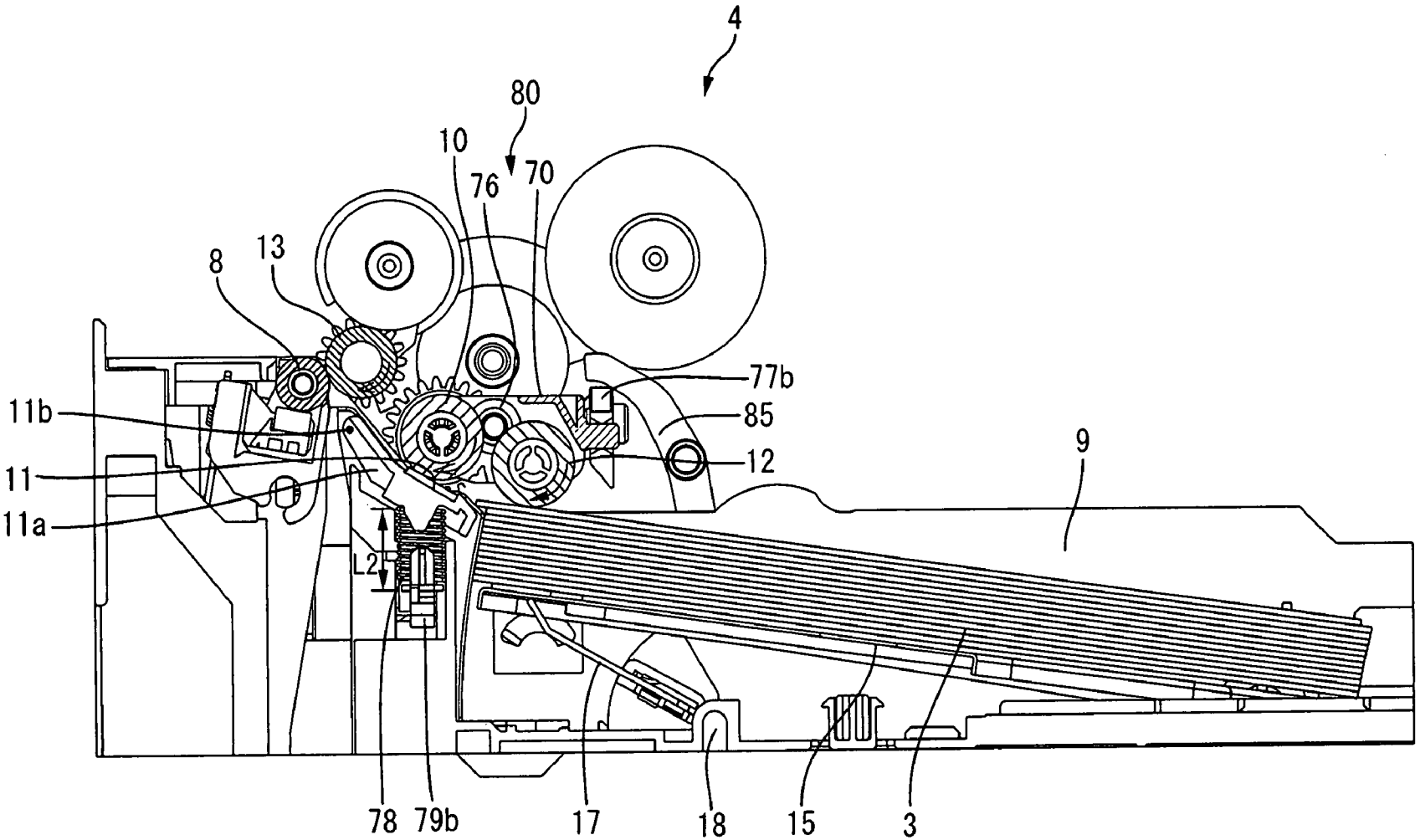
FIG. 16 is left cross-sectional view in a high-pressure state of the feeder section.

By means of rotation of the second cam 91, the rear end portion of the separation lever 86 goes beyond the large-diameter section 91*b*, whereby the end section 79*c* of the arm member 79 is pushed downwardly. As a result, as shown in FIG. 16, the end section 79*b* of the arm member 79 is tilted upwardly, and the spring member 78 is compressively deformed much further [a length L2(<L1) in FIG. 16], whereby the separation pad 11 and the separation roller 10 are brought into the high-pressure state (see also FIG. 6).

Subsequently, the second partially-toothed gear 90 and the separation roller gear 73 mesh with each other, and rotational driving (i.e., transmission of driving force from the input gear 81 to the separation roller 10) of the separation roller 10 is initiated. The sheet feeding roller 12 is also rotationally driven so as to follow rotational driving action, whereby the operation for feeding the sheet 3 is started.

As mentioned above, the sheet feeding roller 12 contacts the pile of sheets, thereby delivering the sheets downstream in the conveying direction. The topmost one of the sheets 3 is separated in the separation position X between the separation pad 11 and the separation roller 10 which are pressed against each other under the comparatively-high impelling force corresponding to the length L2.

Figure 17:
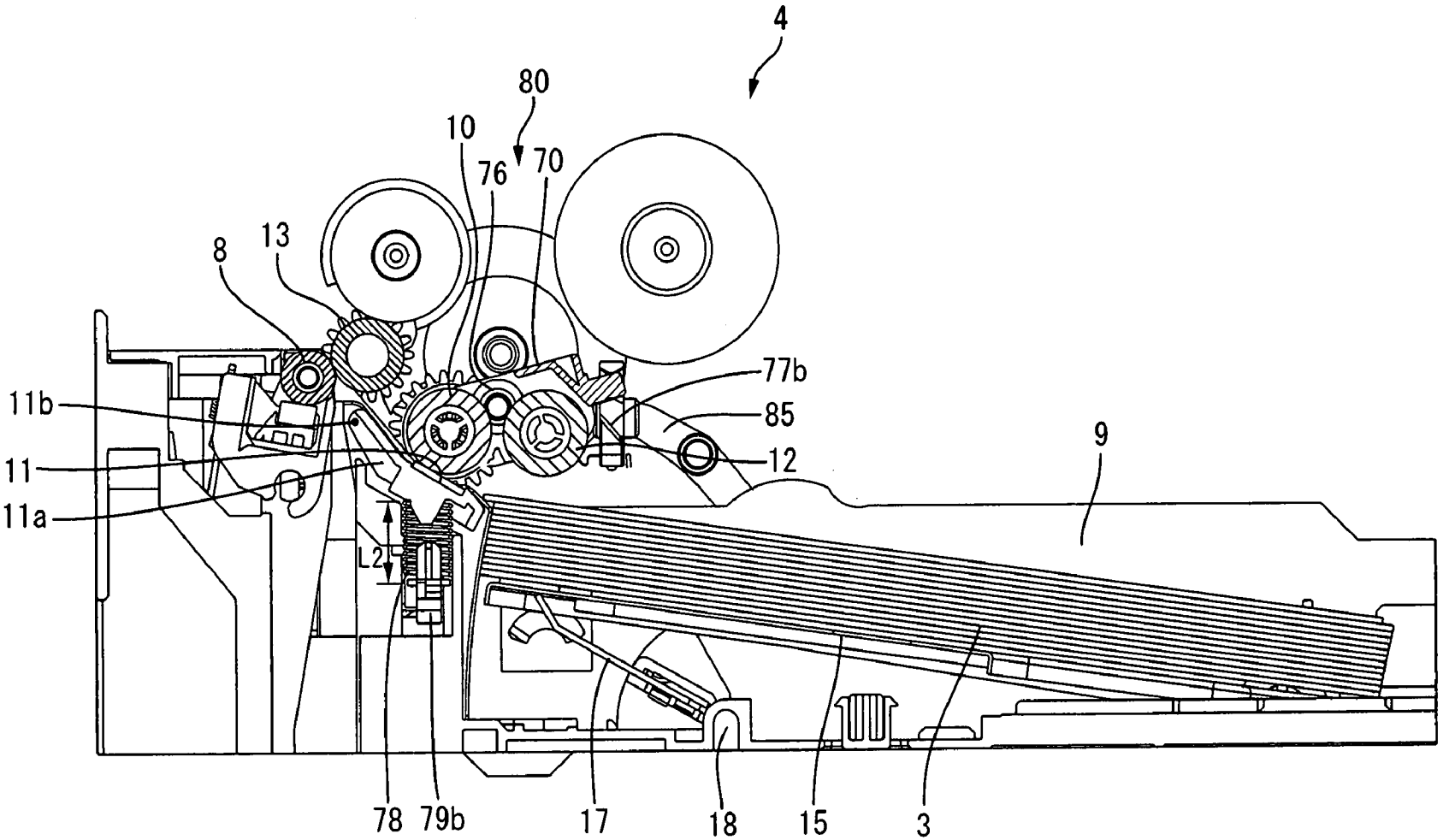
FIG. 17 is a left cross-sectional view in a state where the paper-feeding roller is moved upwardly of the feeding section.

Elevation of the Sheet Feeding Roller, and Reduction in Pressure of Separation Pad Subsequently, when the leading end of the sheet 3 separated by the separation pad 11 and the separation roller 10 has reached the nip position between the paper dust removal roller 8 and the opposing roller 13, a protruding end 92*a* of the third cam 92 starts contacting a tapered face 85*c* formed in the extremity part of the base end of the lift lever 85. The lift lever 85 is gradually guided, as being guided by the tapered face 85*c*, up to the position where the lift lever 85 again downwardly pushes the end 77*c* of the arm member 77. As shown in FIG. 17, the sheet feeding roller 12 moves to the initial position spaced from the pile of sheets loaded on the sheet-pressing plate 15 (the sheet feeding roller elevation operation).

Next, the rear end portion of the separation lever 86 enters from the large-diameter section 91*b* to the small-diameter section 91*a* of the second cam 91. As a result, upward movement of the end section 79*c* of the arm member 79 is allowed. As shown in FIG. 14, the spring member 78 returns to the length L1 and enters the low-pressure state where the impelling force, which is weaker than that achieved at the time of initiation of the sheet-feeding operation, is exerted on the separation pad 11 and the separation roller 10 (pressure reduction operation).

Here, the sheet feeding roller 12 has already been in the initial position, and hence transport resistance resulting from contact with the sheet feeding roller 12 does not arise. Accordingly, even when the pressure between the separation pad 11 and the separation roller 10 is reduced, sufficient separation performance can be exhibited. At this time, there is no transport resistance stemming from the sheet feeding roller 12, and the transport resistance resulting from the separation pad 11 and the separation roller 10 is reduced. Hence, transport of the sheet 3 performed by the paper dust removal roller 8, the opposing roller 13, and the registration roller 14 becomes smooth.

Subsequently, when the toothless portion of the first partially-toothed gear 89 opposes the input gear 81, the sector gear 84 is again brought into the first latch state by the first solenoid arm 111, and returns to the state achieved when the sector gear 84 is in the home position. As a result, the separation roller 10 becomes idle. Accordingly, the range of rotation of the sector gear 84 achieved from when the sector gear is released from the second latch state to when the sector gear transitions to the home position corresponds to the "drive rotation range" of the present invention.

In a subsequent process, every time the print request signal for second and subsequent sheets 3 is given to the control circuit 61, the gear mechanism 80 repeatedly performs the above-described series of operations.

Paper Presence/Absence Sensor, and Sheet-Feeding Operation

Figure 18:
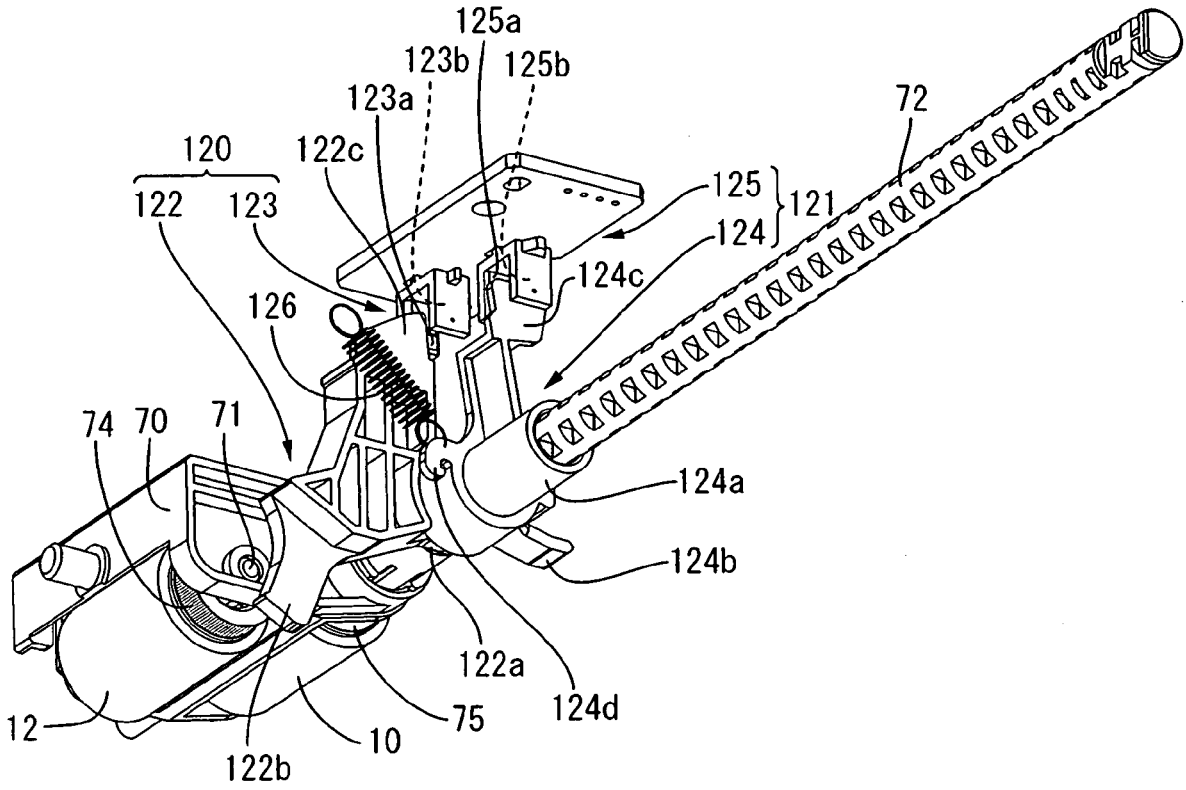
FIG. 18 is a perspective view showing a PE sensor and a cassette detection sensor.
Figure 19:
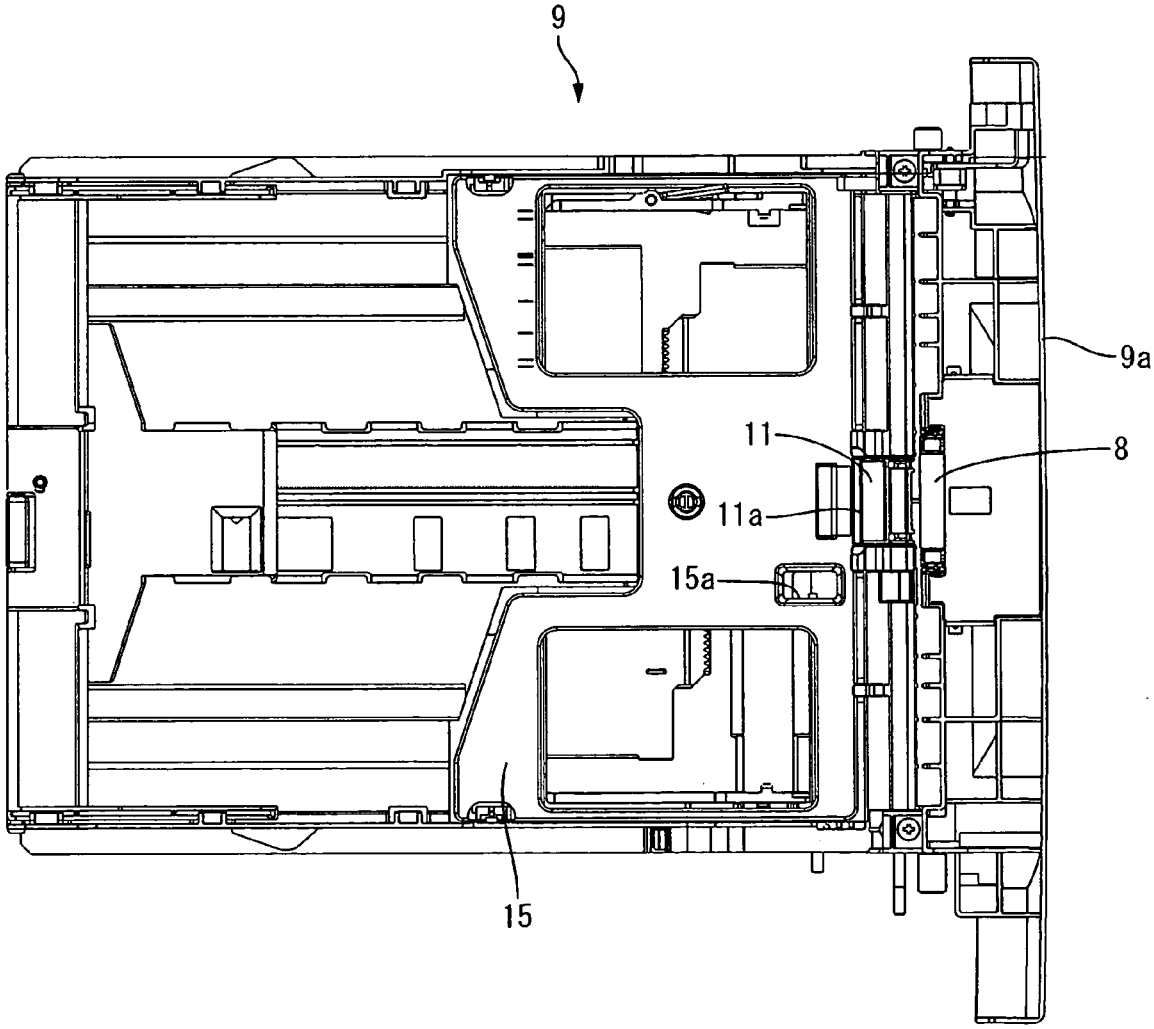
FIG. 19 is a top view of the sheet feeding cassette.

The laser printer 1 of the illustrative aspect has a paper presence/absence sensor (hereinafter described as a "PE sensor" 120) for detecting depletion of the sheets 3 on the sheet-pressing plate 15; and a cassette detection sensor 121 for outputting a detection signal corresponding to the result of a determination as to whether or not the sheet feeding cassette 9 is loaded in the main body 4*a* of the apparatus (i.e., an attached state shown in FIG. 1). FIG. 18 is a perspective view showing the PE sensor 120 and the cassette detection sensor 121 (the lower right direction in the drawing corresponds to the front end of the laser print 1). FIG. 19 is a top view of the sheet feeding cassette 9 (the right direction in the drawing sheet corresponds to the front end of the laser printer 1). The PE sensor 120 and the cassette detection sensor 121 are omitted from FIGS. 2 to 6.

PE Sensor

As shown in FIG. 18, the PE sensor 120 includes a swaying member 122 provided on the rotary shaft body 72 in a swingable manner; and a so-called transmission-type photoelectric sensor 123 where a floodlighting section 123*a* and a light-receiving section 123*b* are disposed so as to oppose each other. An annular section 122*a* where the rotary shaft body 72 is to be inserted is formed in essentially the center of the swingable member 122. A contact section 122*b*, which contacts the sheet 3 on the sheet-pressing plate 15, is formed integrally at one downwardly-projecting end of the swingable member 122. A light-shielding section 122*c*, which passes through between the floodlighting section 123*a* and the light-receiving section 123*b* of the photoelectric sensor 123, is formed integrally at the other upper-projecting end of the swingable member 122.

The swingable member 122 is in the state where the contact section 122*b* usually hangs downwardly under the weight of its own. At this time, the light-shielding section 112*c* is situated in a non-light-shielding position (see FIG. 18) separated from the space between the floodlighting section 123*a* and the light-receiving section 123*b*. As shown in FIG. 19, an entry hole 15*a*, into which the contact section 122*b* can enter enters, is formed in a position on the sheet-pressing plate 15 of the sheet feeding cassette 9 corresponding to the contact section 122*b* of the swingable member 122.

Cassette Detection Sensor

The cassette detection sensor 121 includes a pivotal member 124 provided on the rotary shaft body 72 in a pivotable manner, and a so-called transmission-type photoelectric sensor 125 where a floodlighting section 125*a* and a light-receiving section 125*b* are disposed so as to oppose each other. An annular section 124*a* where the rotary shaft body 72 is to be inserted is formed in essentially the center of the pivotal member 124. A contact section 124*b*, which projects forwardly and contacts the sheet feeding cassette 9, is formed integrally in the annular section 124*a*. A light-shielding section 124*c*, which projects upwardly and passes between the floodlight section 125*a* and the light-receiving section 125*b*of the upwardly-projecting photoelectric sensor 125, is formed integrally in the pivotal member 124.

A spring latch section 124*d*, which latches one end of the compression spring 126 serving as urging member, is formed integrally backward of a position on the annular section 124*a* opposite the contact section 124*b*. By means of the impelling force of the compression spring 126, the pivotal member 124 is maintained in an state in an natural state where the contact section 124*b* projects in a forwardly down tilt direction. At this time, the light-shielding section 124*c* is situated in a non-light-shielding position outside the floodlight section 125*a* and the light-receiving section 125*b*. FIG. 18 shows that the light-shielding section 124*c* is in the light-shielding position between the floodlight section 125*a* and the light-receiving section 125*b*.

Operation of PE Sensor and Operation of Cassette Detection Sensor

Figure 20:
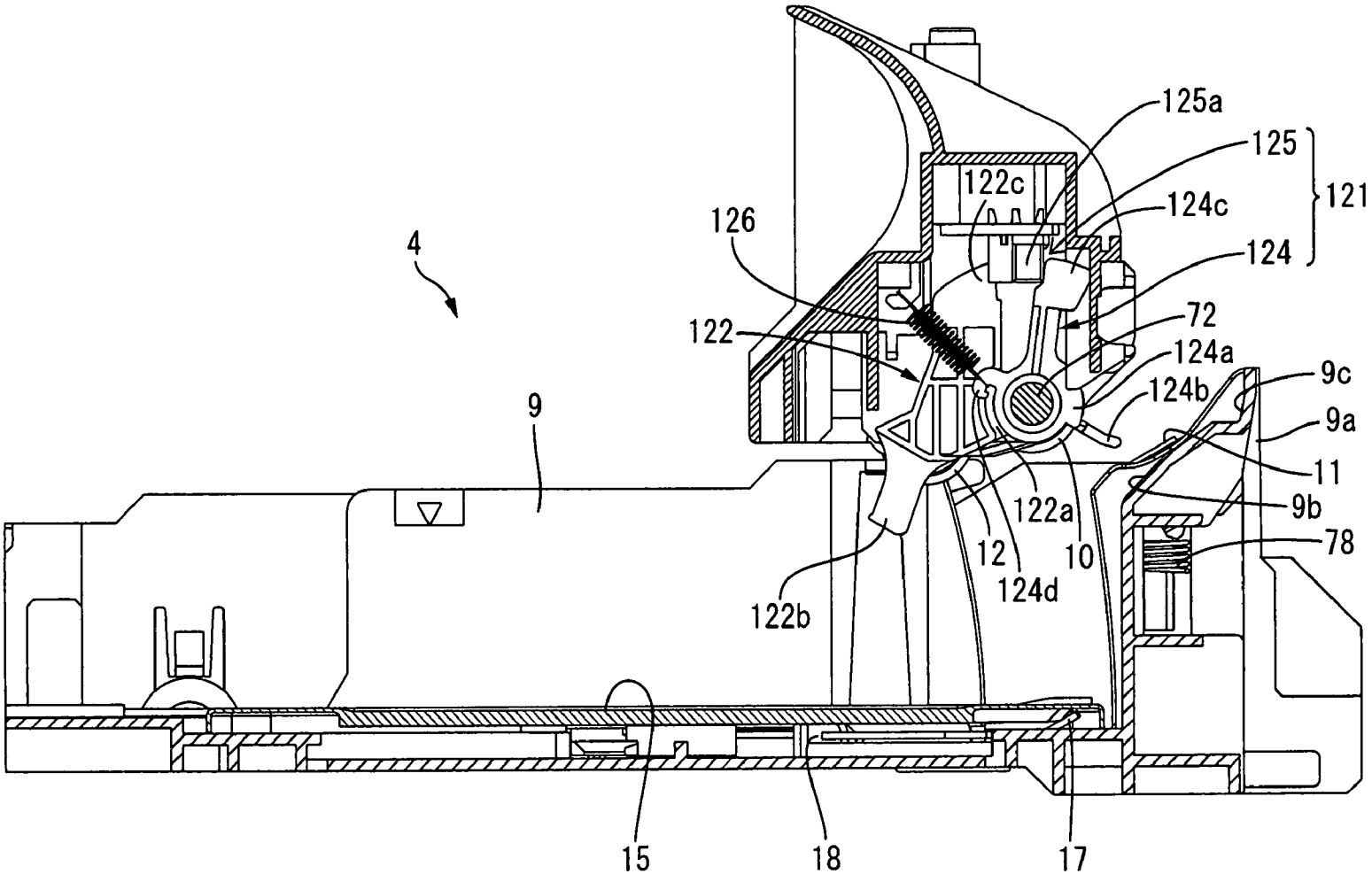
FIG. 20 is a right cross-sectional view of the feeder section achieved when the sheet feeding cassette is drawn.
Figure 21:
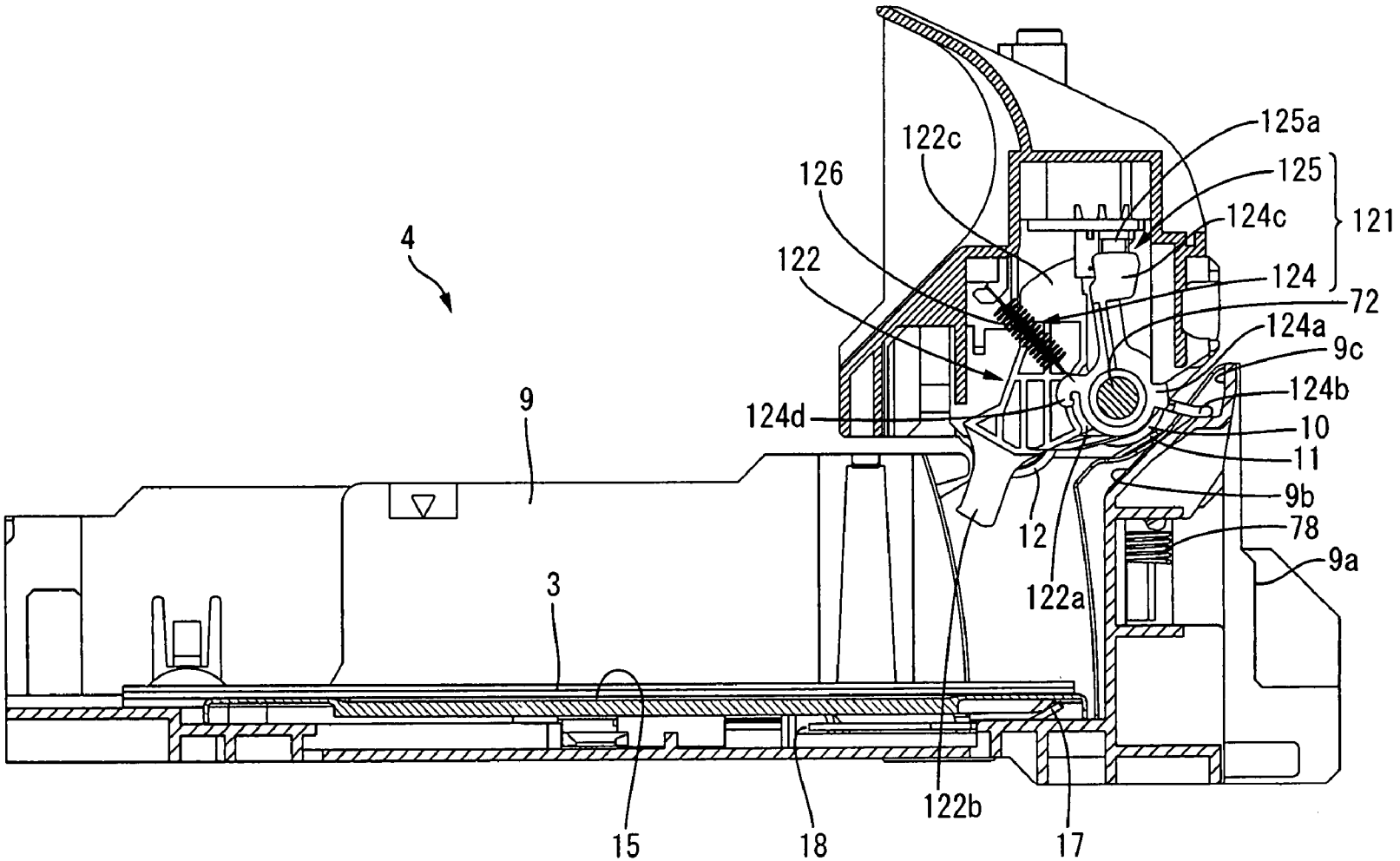
FIG. 21 is a right cross-sectional view showing completion of attachment of the sheet-perform cassette with the small amount of sheets.

FIG. 20 is a right cross-sectional view of the feeder section 4 achieved when the sheet feeding cassette 9 is drawn (a rightward direction in the drawing corresponds to the front end of the laser printer 1), and FIG. 21 is a right cross-sectional view of the feeder section 4 achieved when attachment of the sheet feeding cassette 9 has been completed.

As illustrated, a tapered face 9*a*, which is tilted in a rear downward direction, is formed in the upper end of a front cover section 9*a* of the sheet feeding cassette 9. An indentation 9*c* is opened in the upper end of the front cover section 9*a*. As shown in FIG. 20, when the sheet feeding cassette 9 is drawn from the apparatus main body 4*a*, the pivotal member 124 enters the state where the contact section 124*b* projects in a downwardly-tilted forward direction, under restoration force of the compression spring 126, and hence the light-shielding section 124*c* comes to the non-light-shielding position for the photoelectric sensor 125.

Figure 24:
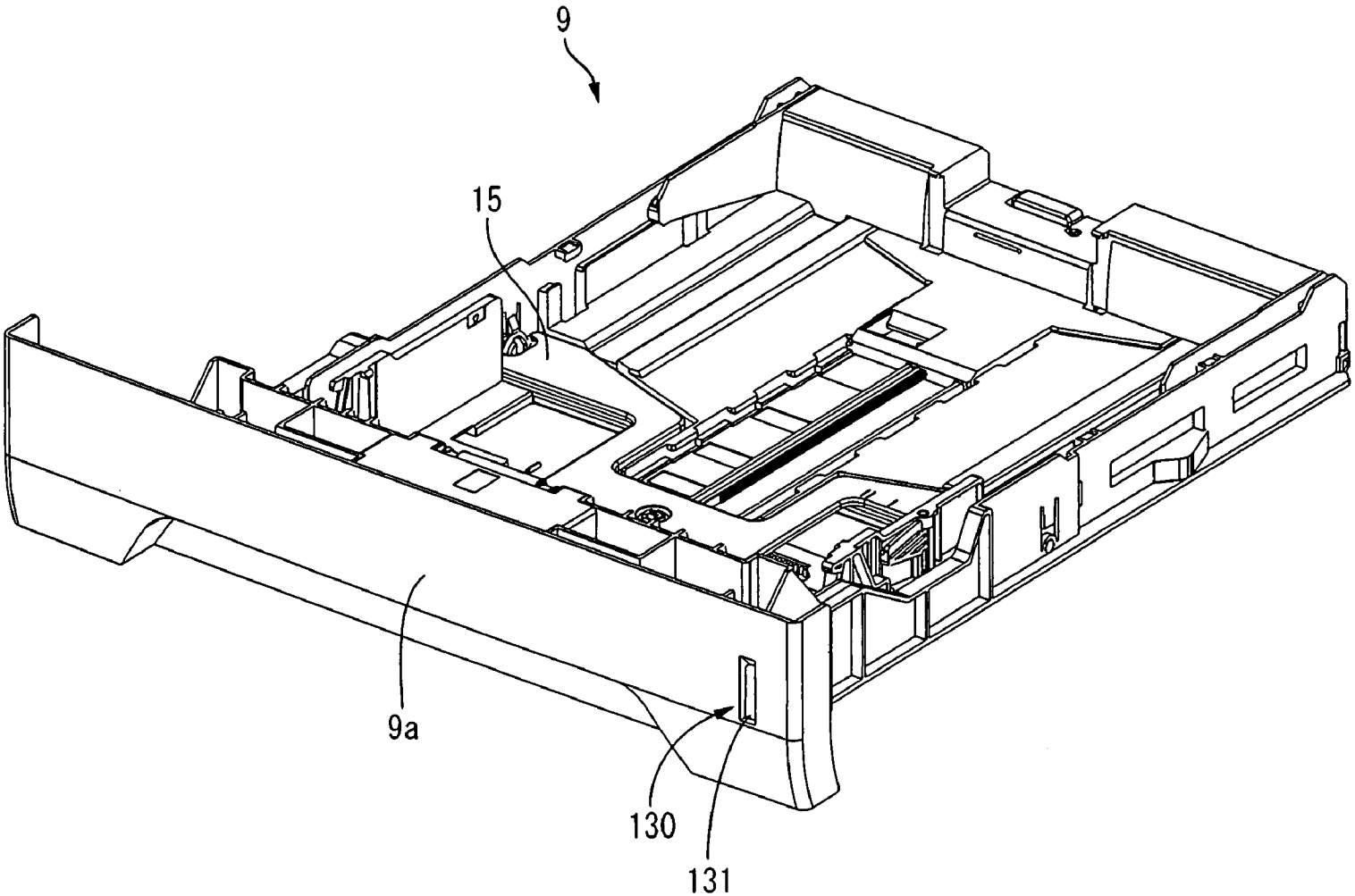
FIG. 24 is a perspective view of a sheet feeding cassette when viewed from the front end thereof.

For example, when the sheets 3 are set in the sheet feeding cassette 9 and the sheet feeding cassette 9 is again attached to the apparatus main body 4*a*, the contact section 124*b* is guided by the tapered face 9*b* of the sheet feeding cassette 9, and the pivotal member 124 pivots counterclockwise in the drawing sheet against the impelling force of the compression spring 126. As shown in FIG. 24, the contact section 124*b* enters the indentation section 9*c*, and the pivotal member 124 is latched in this pivotal position. At this time, the light-shielding section 124*c* comes to the light-shielding position for the photoelectric sensor 125, and the detection signal output from the photoelectric sensor 125 is imparted to the control circuit 61. Specifically, attachment of the sheet feeding cassette 9 is transmitted to the control circuit 61.

Figure 22:
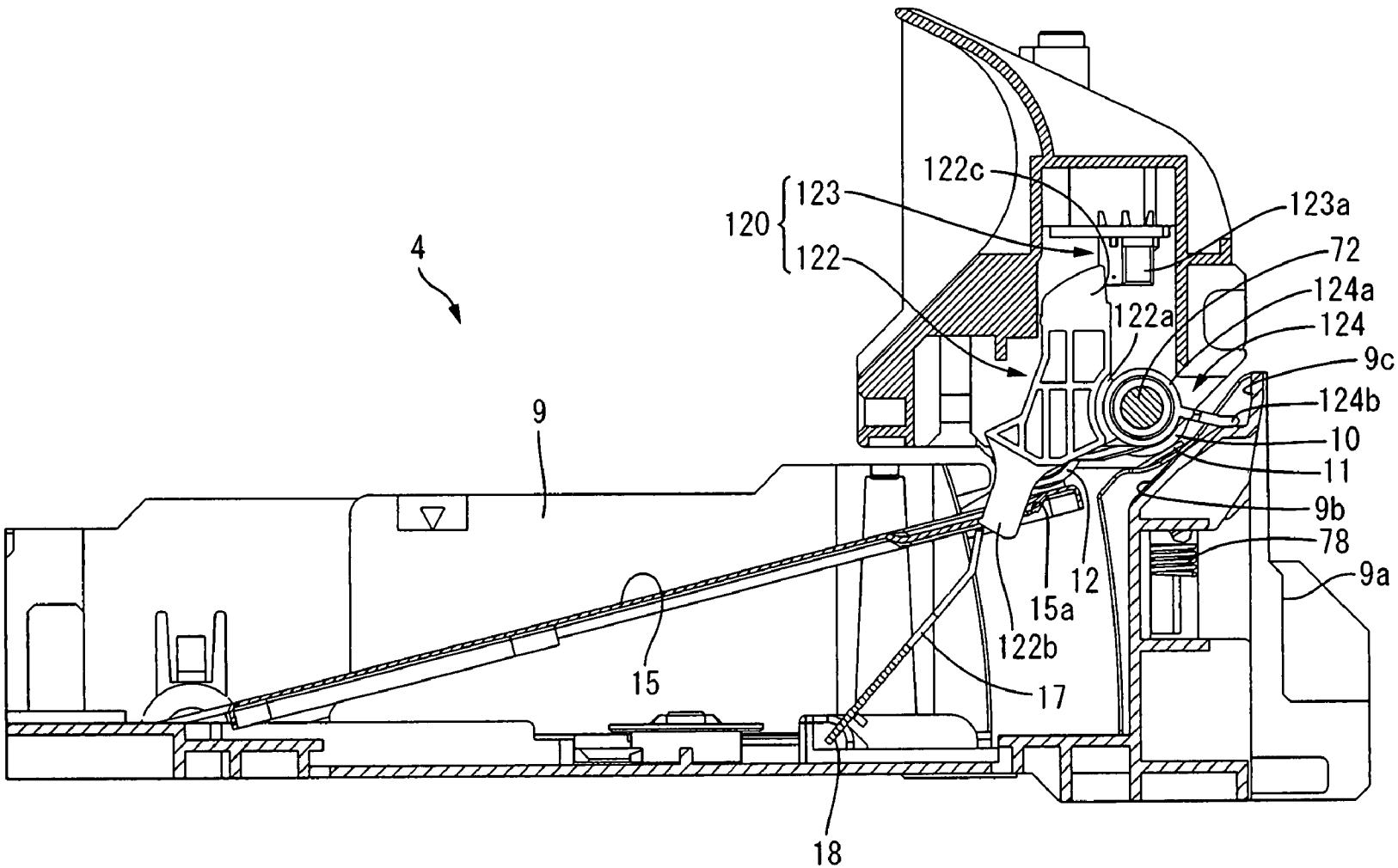
FIG. 22 is a right cross-sectional view of the feeder section achieved when the sheet-pressing plate has been elevated with no sheets.
Figure 23:
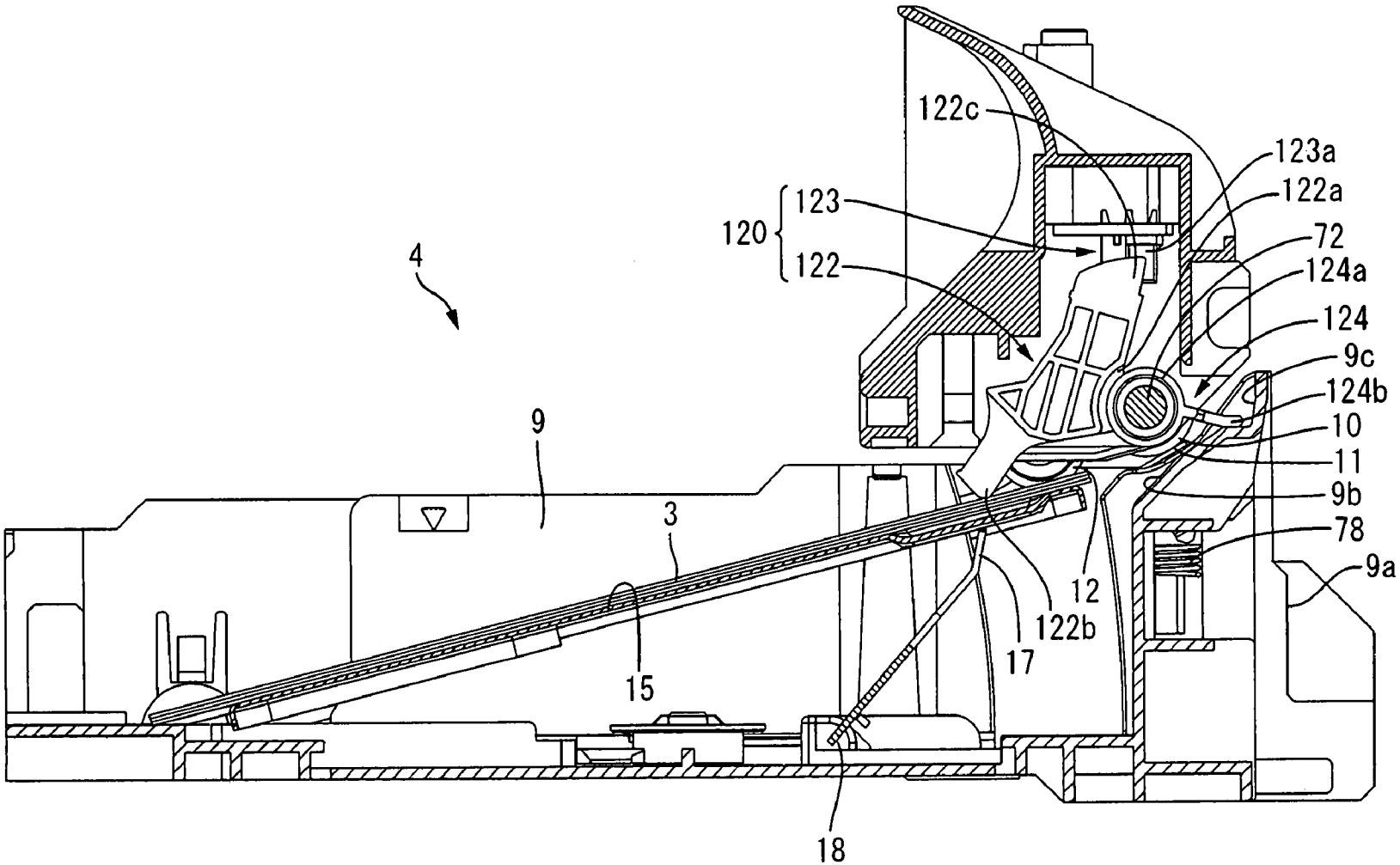
FIG. 23 is a right cross-sectional view of the feeder section achieved when the sheet-pressing plate has been elevated with a small amount of sheets.

FIG. 22 is a right cross-sectional view (a rightward direction in the drawing sheet corresponds to the front end of the laser printer 1) of the feeder section achieved when the sheet-pressing plate 15 is elevated without the sheets 3. FIG. 23 is a right cross-sectional view of the feeder section achieved when the sheet-pressing plate 15 is elevated with the sheets 3.

As shown in FIG. 22, when the sheets 3 are not on the sheet-pressing plate 15, the contact section 122*b* enters the entrance hole 15*a*, and the pivotal member 122 maintains the state where the light-shielding section 122*c* is in the non-light-shielding position for the photoelectric sensor 123. In contrast, as shown in FIG. 23, when the sheets 3 are provided on the sheet-pressing plate 15, the contact section 122*b* comes into contact with the surface of the top sheet 3, and the sheet is raised upward. In association with upward raise of the sheet 3, the swingable member 122 sways, and the light-shielding section 122*c* enters the light-shielding position for the photoelectric sensor 123. The photoelectric sensor 123 imparts a detection signal showing presence of sheets to the control circuit 61.

The detection position (the swaying position of the contact section 122*c*) where the PE sensor 120 detects presence/absence of the sheets 3 is made to correspond to the position where the top sheet 3 on the sheet-pressing plate 15 has come into contact with the sheet feeding roller 12 and become able to be fed by the sheet feeding roller 12. Specifically, when the sheet feeding roller 12, which has been lifted by the top sheet 3 on the sheet-pressing plate 15, has come to the predetermined height, the photoelectric sensor 123 is shielded by the light-shielding section 122*c*, thereby outputting a detection signal.

Sheet Indicator

Figure 25A:
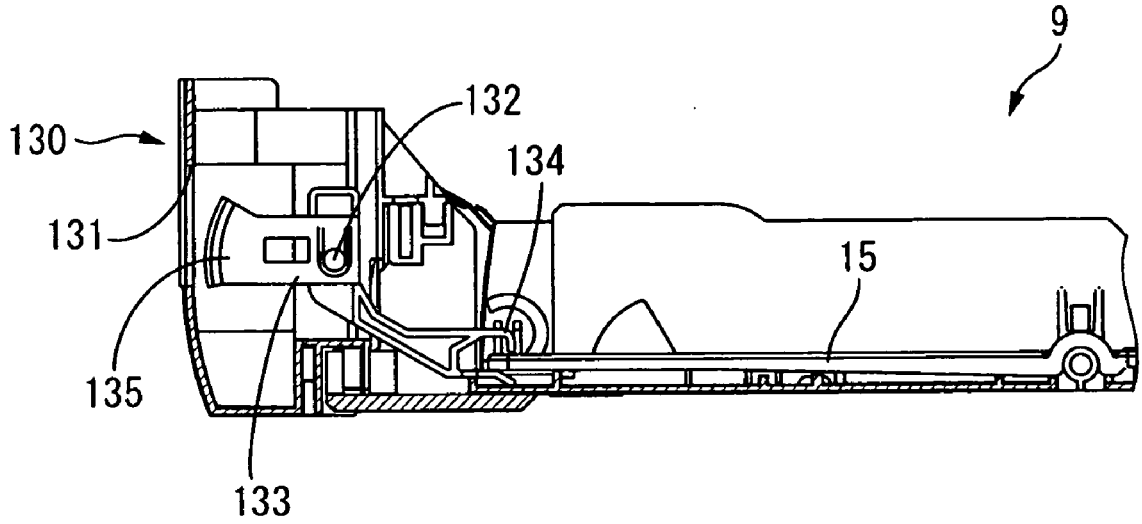
FIGS. 25A and 25B are left side cross-sectional views of the sheet feeding cassette, showing a relationship between elevation of the sheet-pressing plate and operation of a sheet indicator.
Figure 25B:
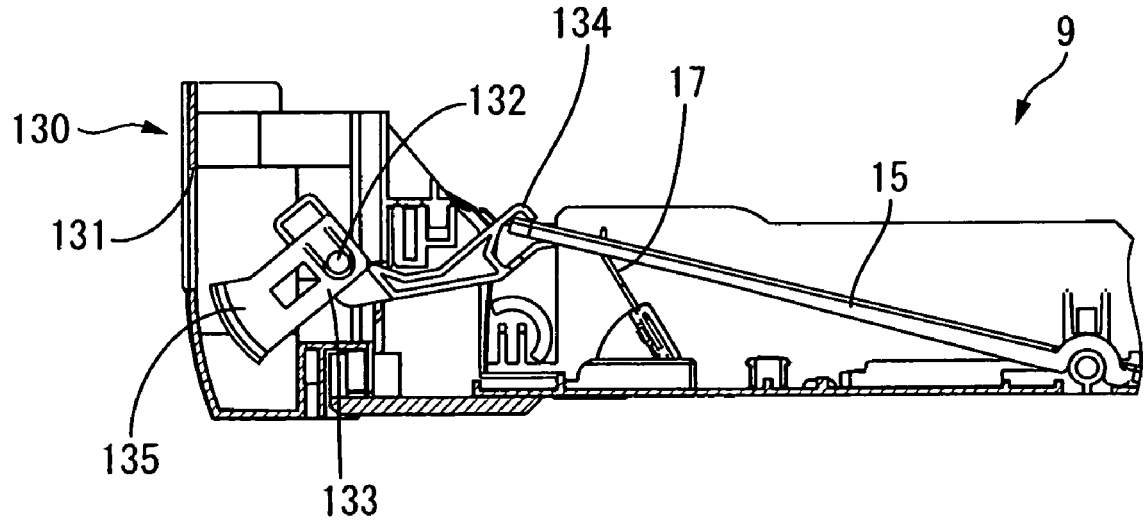

In the illustrative aspect, the sheet feeding cassette 9 is provided with a sheet indicator 130 which shows the amount of sheets 3 left on the sheet-pressing plate 15. FIG. 24 is a perspective view of the sheet feeding cassette 9 when viewed from the front end thereof. FIGS. 25A and 25B are left cross-sectional views of the sheet feeding cassette showing a relationship between elevation of the sheet-pressing plate 15 and operation of the sheet indicator 13 (a leftward direction in the drawing corresponds to the front end of the laser printer 1).

As shown in FIG. 24, a slit-shaped sight glass 131 is formed in one end of the front cover section 9*a* of the sheet feeding cassette 9. As shown in FIGS. 25A and 25B, a tilt member 133, which is provided so as to be able to tilt with respect to the center of a rotary shaft 132 parallel to the rotary shaft body 72 or the like, is provided at a position in a direction away from the sight glass 131. The entirety of the tilt member 133 assumes a shape bent into a crank. An engagement section 134, which is engaged with the pivotal end of the sheet-pressing plate 15, is provided at a rear end of the tilt member 133. An indicator section 135, which vertically moves in the longitudinal direction of the sight glass 131, is provided at the front end of the tilt member 133 which opposes an interior surface of the front cover section 9*a*.

As shown in FIG. 25A, when the amount of residual sheets 3 in the sheet feeding cassette 9 is large and the sheet-pressing plate 15 is situated in a position close to the loading position (the sheets 3 are omitted from the drawing), the indicator section 135 ascends to a position where essentially the entirety of the indicator section can be viewed by way of the sight glass 131. As shown in FIG. 25B, when the amount of sheets 3 remaining in the sheet feeding cassette 9 becomes smaller and the sheet-pressing plate 15 ascends, the indicator section 135 descends below the sight glass 131, so that only a part of the indicator section is viewed. Thus, the amount of sheets 3 remaining on the sheet-pressing plate 15 can be ascertained on the basis of the position of the indicator section 135 in the sight glass 131.

Control Operation by the Control Circuit

Figure 26:
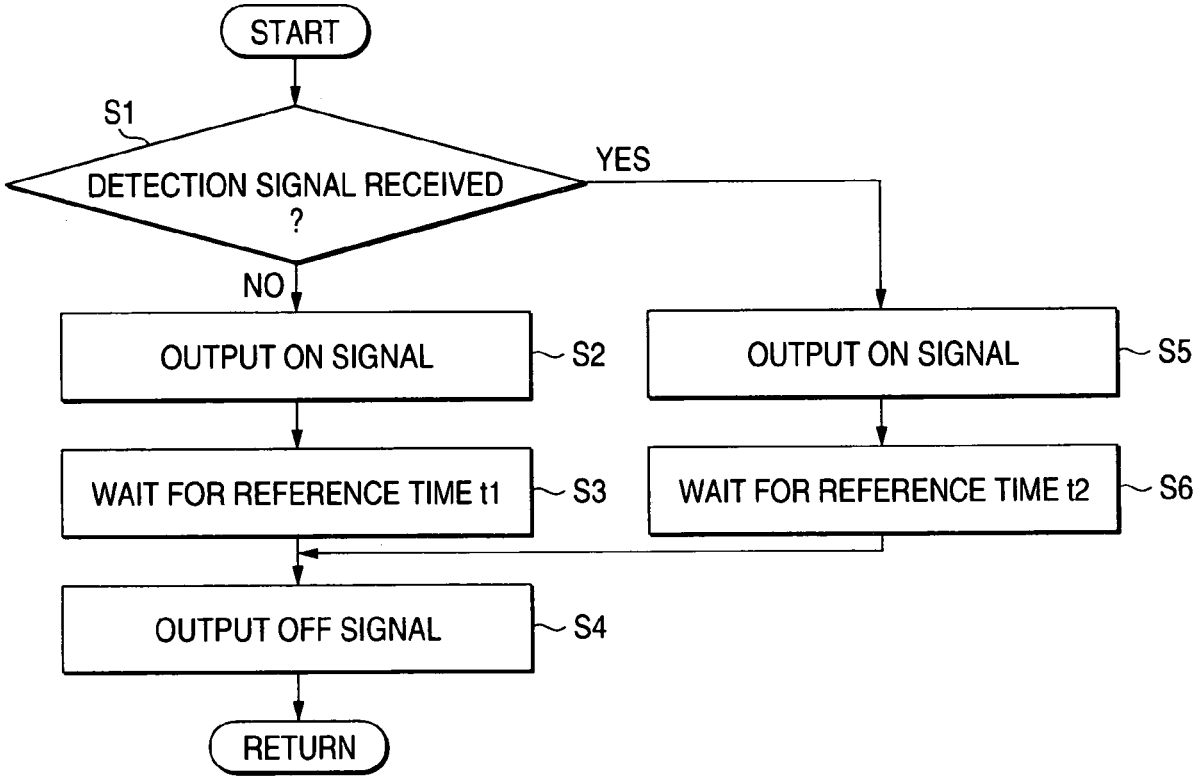
FIG. 26 is a flowchart showing control operation of a control circuit.

FIG. 26 is a flowchart showing control operation of the control circuit 61.

When having received an input of the print request signal, the control circuit 61 determines, in S1, whether or not a detection signal has been received from the cassette detection sensor 121 (whether or not a non-detection signal has been switched to the detection signal) after preceding print operation and before the print request signal is received. If the detection signal is not received, operation for re-attaching the sheet feeding cassette 9 (operation for temporarily drawing the sheet feeding cassette 9 from the apparatus main body 4*a* and resetting the thus-drawn sheet feeding cassette 9) has not yet been performed.

As shown in FIG. 14, this means that the sheet-pressing plate 15 is situated in the feeding position; that the top sheet 3 is in close proximity to the sheet feeding roller 12; and that sheet-feeding operation can be performed immediately when the print request signal has been received. Accordingly, the control circuit 61 imparts the ON signal to the solenoid switch 81, to thus activate the solenoid switch 81 (S2). Subsequently, the control circuit 61 imparts the OFF signal after having waited for an extremely short period of a first reference time t1, to thus deactivate the solenoid switch 81 (S3, S4). Thereby, the sheet feeding roller 12 is released from the first latch state in the home position (see FIGS. 7 and 8), and switching of the sheet feeding roller 12 is performed. After the sheet-pressing plate 15 has entered a state where the sheet-pressing plate 15 can be elevated (FIGS. 9 and 10), the sheet feeding roller 12 is immediately released from the second latch state, and the sheet-feeding operation for rotationally driving the sheet feeding roller 12 is performed (FIGS. 11 and 12).

In the meantime, when the detection signal has been received, the sheet feeding cassette 9 is re-attached. As shown in, e.g., FIG. 21, this means that the sheet-pressing plate 15 is in the loading position, and that sheet-feeding operation cannot be performed properly unless the sheet-pressing plate 15 is elevated to the feeding position. Therefore, the control circuit 61 imparts the ON signal to the solenoid switch 82, to thus activate the solenoid switch 82 (S5). After having waited until a second reference time t2 (>time t1) lapses, the control circuit 61 imparts the OFF signal to the solenoid switch 82, to thus deactivate the solenoid switch 82 (S6, S4). Thus, the sheet feeding roller 12 is released from the first latch state in the home position (FIGS. 7 and 8), and switching of the sheet feeding roller 12 is performed, to thus bring the sheet-pressing plate 15 into a state where the sheet-pressing plate 15 can be elevated (FIGS. 9 and 10). After the sheet-pressing plate 15 has been elevated to the feeding position, the sheet feeding roller 12 is released from the second latch state, whereby sheet-feeding operation for rotationally driving the sheet feeding roller 12 is performed (FIGS. 11 and 12). The first reference time t2 may be changed as appropriate. Moreover, the OFF signal may be imparted immediately without causing the control circuit to wait during the first reference time t1.

The above-described second reference time t2 is set to the maximum elevation time required for the sheet-pressing plate 15 to ascend from the loading position to the feeding position. Specifically, the second reference time is set to a time (three seconds in the illustrative aspect) required for the sheet-pressing plate 15 to ascend from the loading position to the feeding position with a small number of sheets 3 (e.g., one sheet)

loaded on the sheet-pressing plate 15. This second reference time t2 may be changed as appropriate.

Advantages of the Illustrative aspect

According to the illustrative aspect, when the print request signal for the first sheet 3 is input after the sheet feeding cassette 9 has been rest, switching of the sheet feeding roller 12 is performed, and lapse of only the reference time "t" is awaited. After the sheet-pressing plate 15 has ascent from the loading position to the feeding position, the sheet feeding roller 12 is rotationally driven, thereby performing sheet-feeding operation properly. When a print request signal for the second or subsequent sheet 3 is input, the sheet-pressing plate 15 has already been in the feeding position. Hence, after switching of the sheet feeding roller 12 has been performed, the sheet feeding roller 12 is immediately rotationally driven, thereby immediately performing sheet-feeding operation without involvement of a useless wait time.

Since the first cam 88 that performs switching operation by means of rotation is arranged coaxially with the sector gear 84, the switching timing can be set readily by positional adjustment of the sector gear 84 and the first cam 88 in the rotating direction. Moreover, the number of parts can be curtailed by integrally forming the first cam 88 and the sector gear 84.

The sector gear 84 is latched by the solenoid arms 111, 112 on the upper and lower sides of the plane N including the rotary shaft 87 of the sector gear 84 and the axes 110*a*, 110*b* of the respective solenoid arms 111, 112. Consequently, the solenoid arms 111, 112 can be latched with a margin when compared with a case where the solenoid arms are latched on a single side with reference to the plane N.

Latching of the first solenoid arm 111 and latching of the second solenoid arm 112 are performed in positions which are offset in the horizontal direction. Hence, latching and releasing operations can be smoothly performed without interference.

Since the solenoid switch 82 is a keep solenoid switch, the keep solenoid switch 82 maintains an active state even when power-on has been interrupted by, e.g., a power failure, in the second latch state (i.e., an active state of the solenoid switch 82) where the second solenoid arm 112 latches the second latch protrusion 84*b*. Hence, the feeding operation can be performed as is during power is again turned on. Further, the amount of remaining sheets can also be accurately disallowanceed by the sheet indicator 130.

Other Configurations

The present invention is not limited to the illustrative aspect that has been explained by the above descriptions and the drawings. For example, the following illustrative aspects will fall within the technical scope of the present invention. Moreover, the present invention can be carried out, in a manner other than the following illustrative aspects, while being variously altered within the scope of the invention.

(1) In the illustrative aspect, the timing of rotational driving of the sheet feeding roller 12 is changed on the basis of whether or not the sheet feeding cassette 9 is reset in accordance with the detection signal from the cassette detection sensor 121 serving as detection means. The timing of rotational driving of the sheet feeding cassette 12 may also be changed in accordance with a detection signal indicating depletion of the sheets from the PE sensor 120. Specifically, the control circuit 61 can ascertain that the sheet feeding cassette 9 has been drawn for replenishing sheets and reset, upon receipt of the detection signal. Accordingly, when the print request signal for the first sheet 3 has been received after this detection signal, the sheet feeding roller is released from the second latch state after lapse of the reference time "t" since the sheet feeding roller was released from the first latch state, thereby performing the sheet-feeding operation.

(2) The above illustrative aspect has described the so-called twin-roller type system, wherein the separation roller 10 and the sheet feeding roller 12 are formed from separate rollers. However, there may also be adopted a system where a single roller body is caused to act as the separation roller and the sheet feeding roller.

(3) The sheet-pressing plate 15 may ascend while maintaining a horizontal state.

(4) In the illustrative aspect, the first solenoid arm 111 and the second solenoid arm 112 are made separate from each other. However, the structure of the solenoid arms is not limited to this illustrative aspect. Both solenoid arms may be formed into a single arm and swung so as to achieve the first latch state and the second latch state.

(5) Although the first solenoid arm 111 and the second solenoid arm 112 are made configured to be swingable around the separate axes 110*a*, 110*b*, the arms may be configured to be swingable around a single axis.

As described in detail above, the laser printer 1 is configured that when the housing cassette is not re-attached to the main body of the apparatus and operation for feeding the next sheet is continued, the loading section has already been at a predetermined height (a height at which the sheets can be properly delivered by the delivery roller) . Accordingly, when a signal for starting feeding of the next sheet has been received, feeding operation can be properly performed even when the delivery roller is rotated immediately.

In contrast, when the housing cassette has once been drawn and re-attached for, e.g., replenishing a sheet, the loading section has been situated at the lowest point. Accordingly, there is a necessity for rotating the delivery roller after the loading section has been elevated to the predetermined height.

For these reasons, when operation for attaching the housing cassette is determined to be performed (or to have been performed), the present configuration is arranged to make a timing—at which rotational driving of the delivery roller from switching operation (i.e., when the elevation mechanism becomes drivable as a result of the delivery roller having been switched to the feed position) is initiated—later than in a case where attachment operation is determined not to be performed.

According to the configuration that the cassette detection sensor is provided, a determination can be made as to whether or not attachment operation has been performed, by use of a cassette detection sensor. Hence, an increase in the number of sensors can be curtailed.

According to the configuration that the sheet detection sensor is provided, a determination can be made as to whether or not attachment operation has been performed, by use of a sheet detection sensor. Hence, an increase in the number of sensors can be curtailed.

The laser printer 1 is configured that, before the feeding start signal is received, the drive gear is situated at the first rotational position with the delivery roller being located at the initial position. When the feeding start signal is received, the drive gear is released from the latched state in the first rotational position and brought into a switching rotation range by means of impelling force of the urging member. As a result, the delivery roller is switched to the feed position, and the loading section becomes able to ascend by means of the elevation mechanism. The drive gear is further rotated by the impelling force of the urging member and latched in a second rotational position before the drive rotation range. Subsequently, the drive gear is released from the latched state in the second rotational position at a timing determined by control of the timing control unit. As a result, upon receipt of the driving force from the drive source, the drive gear is rotated, and the delivery roller pivots to thus initiate the operation for feeding a sheet. As mentioned above, the present invention can be implemented by means of a comparatively simple configuration; that is, alteration of the timing at which the drive gear is to be latched.

The laser printer 1 is configured that the cam that performs switching operation by means of rotation is configured to be arranged coaxially with the drive gear. Therefore, the timing of the switching operation can be readily set by means of adjusting the position of the drive gear and that of the cam in their rotational directions. Further, the number of parts can be reduced, so long as the cam and the drive gear are formed integrally.

The laser printer 1 is configured that the drive gear is latched in each of the first and second rotational positions by means of the pair of latch arms consisting of the first and second latch arms. Since one of the latch arms is configured to sway so as to follow the remaining latch arm, the remaining latch arm can also be swung between the latch state and the retracted state by means of swaying the one latch arm between the latch state and the retracted state. Moreover, such a configuration facilitates adjustment of a timing for latching/releasing both latch arms as compared with a configuration where a pair of latch arms are swung independently.

The laser printer 1 is configured that the second latch arm is quickly swung by the alteration member, to thus change its state. In contrast, the first latch arm is swung after a delay corresponding to allowance, thereby changing the state. Specifically, when the alteration member operates while the drive gear is latched in the first rotational position by the first latch arm, the second latch arm is changed to the latch state where the second latch arm can latch the drive gear in the second rotational position. Subsequently, the first latch arm is released from the latched state in the first pivotal position. Accordingly, the second latch arm can perform latching action in the second rotational position without fail.

The laser printer 1 is configured that the respective latch arms latch the drive gear in respective sides with reference to the plane including the rotary shaft of the drive gear and the rotary shafts of the latch arms. Consequently, when compared with a case where the latch arms are latched in on the same side, latching operation with a margin can be performed in a case where both latch arms perform latching action on the same side.

The laser printer 1 is configured that the first and second latch protrusions are located in positions offset in the direction of the rotary shaft of the drive gear, and the first and second latch arms are located in the positions which correspond to and are offset with respect to the first and second latch protrusions. According to the configuration, latching-and-releasing actions of the first latch protrusion and the first latch arm and latching-and-releasing actions of the second latch protrusion and the second latch arm can be performed smoothly without involvement of interference.

The laser printer 1 is configured that the alteration member is a keep solenoid switch that brings the first latch arm into the retracted state when turned on and brings the second latch arm into the latchable state. According to the configuration, even when power-up is interrupted by, e.g., a power failure, with the second latch protrusion being latched by the second latch arm, the keep solenoid preserves its own state. Hence, feeding operation can be carried out when power-up is performed again.

The laser printer 1 is configured to be provided with a sheet indicator that indicates the amount of sheet remaining on the loading section in accordance with an elevated position of the loading section. According to the configuration, even when the sheet indicator is provided, the amount of remaining sheet can be indicated accurately.

The foregoing description of the illustrative aspects has been presented for purposes of illustration and description. It is not intended to be exhaustive or to limit the invention to the precise form disclosed, and modifications and variations are possible in light of the above teachings or may be acquired from practice of the invention. The illustrative aspects were chosen and described in order to explain the principles of the invention and its practical application program to enable one skilled in the art to utilize the invention in various illustrative aspects and with various modifications as are suited to the particular use contemplated. It is intended that the scope of the invention be defined by the claims appended hereto, and their equivalents.

What is claimed is:

1. A sheet feeding apparatus comprising:

a main body;

a housing cassette that has a loading section on which a sheet is loaded and is provided to be movable in a vertical direction, the housing cassette being attached to the main body to be drawable therefrom;

a delivery roller that is provided to be movable in the vertical direction relative to the main body and rotates while remaining in contact with an upper surface of the sheet loaded on the loading section to deliver the sheet downstream with respect to a conveying direction of the sheet;

an elevation mechanism that elevates the loading section on condition that a moving position of the delivery roller is a predetermined height or less while the delivery roller stays in a feed position where the delivery roller contacts with the sheet loaded on the loading section;

a position switching mechanism that switches between an initial position where the delivery roller is separated from the loading section and the feed position;

a drive unit that causes the position switching mechanism to perform switching operation for switching the delivery roller from the initial position to the feed position in accordance with a sheet feeding start signal and subsequently rotationally drives the delivery roller;

a determination unit that determines whether or not operation for attaching the housing cassette to the main body is performed; and a timing control unit that controls a timing, at which the rotational driving is started from the switching operation, to be later in each case where it is determined by the determination unit that the attachment operation is performed, compared to a timing when it is determined by the determination unit that the attachment operation is not performed.

2. The sheet feeding apparatus according to claim 1, further comprising:

a cassette detection sensor that detects whether or not the housing cassette is re-attached;

wherein the determination unit determines that an operation for attaching the housing cassette is performed when the cassette detection sensor detects that the housing cassette is re-attached.

3. The sheet feeding apparatus according to claim 1, further comprising:

a sheet detection sensor that detects whether or not the sheet exists on the loading section;

wherein the determination unit determines that an operation for attaching the housing cassette is performed when the sheet detection sensor detects absence of the sheet.

4. The sheet feeding apparatus according to claim 1, wherein:

the drive unit comprises:

a drive gear that is rotatably provided and has a switching rotation range, where the position switching mechanism is caused to sequentially perform the switching operation from a first rotation position before the feeding start signal is received, and a drive rotation range, where the drive unit causes the delivery roller to perform the rotational drive upon receipt of driving force from a drive source;

an urging member that urges the drive gear in a rotating direction from at least the first rotational position to the drive rotation range; and a latch member that latches the drive gear in the first rotational position until the latch member receives the feeding start signal, releases the drive gear from a latched state in the first rotational position when the feeding start signal is received, latches the drive gear in a second rotational position before the drive rotation range, and subsequently releases the drive gear from the latched state in the second rotational position; and the timing control unit controls latching operation of the latch member in a way that a timing at which the latch member is released from the latched state in the second rotational position after having been released from the latched state in the first rotational position is changed on the basis of a result of determination made by the determination unit.

5. The sheet feeding apparatus according to claim 4, wherein:

the position switching mechanism comprises:

a cam that pivotally moves in association with rotation of the drive gear; and a movement member that contacts with the cam and moves the delivery roller between the initial position and the feed position in accordance with pivotal movement of the cam; and the cam is provided coaxially with respect to the drive gear and rotates integrally with rotation of the drive gear.

6. The sheet feeding apparatus according to claim 5, wherein the cam and the drive gear are formed integrally.

7. The sheet feeding apparatus according to claim 4, wherein:

the drive gear comprises, in sequence with respect to a rotating direction thereof, a first latch protrusion and a second latch protrusion;

the latch member comprises:

a first latch arm that is provided to be swingable between a latch state where the latch member is latchable with the first latch protrusion and a retracted state where the latch member is unlatchable with the first protrusion;

a second latch arm that is provided to be swingable between a latch state where the second latch arm is latchable with the second latch protrusion and a retracted state where the second latch arm is unlatchable with the second latch protrusion; and an alteration member that alters either one of the first latch arm and the second latch arm between the latch state and the retracted state in accordance with the supply start signal and control of the timing control unit; and when the either one of the first latch arm and the second latch arm is in the retracted state, the remaining one of the first latch arm and the second latch arm is in the latch state.

8. The sheet feeding apparatus according to claim 7, wherein:

when the second latch arm is in the retracted state, the first latch arm is in the latch state;

the first latch arm is formed separately from the second latch arm; and the first latch arm has allowance with respect to swaying action of the second latch arm and is swingable so as to follow the swaying action of the second latch arm.

9. The sheet feeding apparatus according to claim 8, wherein:

the first and second latch protrusions are located in positions offset in the direction of the rotary shaft of the drive gear; and the first and second latch arms are located in the positions that correspond to and are offset with respect to the first and second latch protrusions.

10. The sheet feeding apparatus according to claim 7, wherein:

the first and second latch arms are provided to be swingable about an axis parallel to a rotary shaft of the drive gear;

the first latch arm latches with the first latch protrusion on one side of a plane including the rotary shaft and the axis; and the second latch arm latches with the second latch protrusion on a remaining side of the plane.

11. The sheet feeding apparatus according to claim 10, wherein:

the first and second latch protrusions are located in positions offset in the direction of the rotary shaft of the drive gear; and the first and second latch arms are located in the positions that correspond to and are offset with respect to the first and second latch protrusions.

12. The sheet feeding apparatus according to claim 7, wherein the alteration member is a keep solenoid switch that brings the first latch arm into the retracted state when turned on and brings the second latch arm into the latchable state.

13. The sheet feeding apparatus according to claims 12, further comprising a sheet indicator that indicates the amount of sheet remaining on the loading section in accordance with an elevated position of the loading section.

14. An image forming apparatus comprising:

a sheet feeding apparatus that accommodates and feeds a sheet; and an image forming section that forms an image on the sheet fed from the sheet feeding apparatus, wherein the sheet feeding apparatus comprises:

a main body;

a housing cassette that has a loading section on which a sheet is loaded and is provided to be movable in a vertical direction, the housing cassette being attached to the main body to be drawable therefrom;

a delivery roller that is provided to be movable in the vertical direction relative to the main body and rotates while remaining in contact with an upper surface of the sheet loaded on the loading section to deliver the sheet downstream with respect to a conveying direction of the sheet;

an elevation mechanism that elevates the loading section on condition that a moving position of the delivery roller is a predetermined height or less while the delivery roller stays in a feed position where the delivery roller contacts with the sheet loaded on the loading section;

a position switching mechanism that switches between an initial position where the delivery roller is separated from the loading section and the feed position;

a drive unit that causes the position switching mechanism to perform switching operation for switching the delivery roller from the initial position to the feed position in accordance with a sheet feeding start signal and subsequently rotationally drives the delivery roller;

a determination unit that determines whether or not operation for attaching the housing cassette to the main body is performed; and a timing control unit that controls a timing, at which the rotational driving is started from the switching operation, to be later in each case where it is determined by the determination unit that the attachment operation is performed, compared to a timing when it is determined by the determination unit that the attachment operation is not performed.

* * * * *